US009387711B2

(12) United States Patent
Kyoso

(10) Patent No.: US 9,387,711 B2
(45) Date of Patent: Jul. 12, 2016

(54) IMAGE RECORDING APPARATUS AND METHOD

(71) Applicant: FUJIFILM Corporation, Tokyo (JP)
(72) Inventor: Tadashi Kyoso, Ashigarakami-gun (JP)
(73) Assignee: FUJIFILM Corporation, Tokyo (JP)

( * ) Notice: Subject to any disclaimer, the term of this patent is extended or adjusted under 35 U.S.C. 154(b) by 0 days.

(21) Appl. No.: 14/733,593
(22) Filed: Jun. 8, 2015
(65) Prior Publication Data
US 2016/0059599 A1 Mar. 3, 2016
(30) Foreign Application Priority Data
Aug. 28, 2014 (JP) ..... 2014-174135

(51) Int. Cl.
*B41J 2/21* (2006.01)
*B41J 2/045* (2006.01)
*B41J 29/38* (2006.01)
*B41J 2/165* (2006.01)

(52) U.S. Cl.
CPC ..... *B41J 29/38* (2013.01); *B41J 2/0451* (2013.01); *B41J 2/04558* (2013.01); *B41J 2/16579* (2013.01); *B41J 2/16585* (2013.01); *B41J 2/2139* (2013.01); *B41J 2/2142* (2013.01); *B41J 2/2146* (2013.01); *B41J 2002/1657* (2013.01)

(58) Field of Classification Search
CPC ..... B41J 2/2139; B41J 2/2142
See application file for complete search history.

(56) References Cited

U.S. PATENT DOCUMENTS

2003/0063154 A1* 4/2003 Goto ..... B41J 2/2142 347/9
2004/0169693 A1 9/2004 Nakamura
2010/0303281 A1* 12/2010 Wu ..... B41J 2/2142 382/100
2012/0250040 A1* 10/2012 Yamazaki ..... B41J 2/2135 358/1.8
2013/0329144 A1* 12/2013 Fukasawa ..... B41J 2/2142 349/19
2015/0191019 A1* 7/2015 Ohnishi ..... B41J 2/2142 347/14
2015/0336381 A1* 11/2015 Kyoso ..... B41J 2/16579 347/14

FOREIGN PATENT DOCUMENTS

JP H08-187881 A 7/1996
JP 2004-209460 A 7/2004
JP 2013-129112 A 7/2013
JP 2014-091300 A 5/2014

* cited by examiner

*Primary Examiner* — Shelby Fidler
(74) *Attorney, Agent, or Firm* — Studebaker & Brackett PC

(57) ABSTRACT

In an image recording method of an image recording apparatus provided with an inspection unit which inspects the presence/absence of abnormality in each recording element of a print head at regular intervals, the recording element determined to have abnormality by inspection in the inspection unit is disabled during a determination period set in advance. If the disabled recording element is determined to have no abnormality by inspection immediately after the recording element is disabled, recovers the recording element to be enabled. If the disabled recording element is determined to have abnormality again by inspection within a prescribed frequency N from inspection immediately after the recording element is disabled, the recording element is continuously disabled during the determination period. In cases where the recording element is disabled, the use of the disabled recording element is prohibited, image defect due to the use-prohibited recording element is complemented, and an image is recorded.

16 Claims, 25 Drawing Sheets

★ WHEN TRULY ABNORMAL NOZZLE IS PRESENT — GOOD : REACTION IS RAPID

| PAGE | 1 | 2 | 3 | 4 | 5 | 6 | 7 | 8 | 9 | 10 | ··· |
|---|---|---|---|---|---|---|---|---|---|---|---|
| INSPECTION | OK | OK | NG | NG | NG | NG | NG | NG | NG | NG | ··· |
| DETERMINATION | E | E | D | D | D | D | D | D | D | D | ··· |
| COMPLEMENT | OFF | OFF | OFF | ON | ON | ON | ON | ON | ON | ON | ··· |
| IMAGE DEFECT | OK | OK | NG | OK | OK | OK | OK | OK | OK | OK | ··· |

★ WHEN UNSTABLE NOZZLE IS PRESENT — GOOD : UNSTABLE NOZZLE CAN BE STOPPED

| PAGE | 1 | 2 | 3 | 4 | 5 | 6 | 7 | 8 | 9 | 10 | ··· |
|---|---|---|---|---|---|---|---|---|---|---|---|
| INSPECTION | OK | OK | NG | OK | NG | OK | NG | OK | NG | OK | ··· |
| DETERMINATION | E | E | D | E | D | D | D | D | D | D | ··· |
| COMPLEMENT | OFF | OFF | OFF | ON | OFF | ON | ON | ON | ON | ON | ··· |
| IMAGE DEFECT | OK | OK | NG | OK | NG | OK | OK | OK | OK | OK | ··· |

FIG. 17A

★ WHEN TRULY ABNORMAL NOZZLE IS PRESENT GOOD : REACTION IS RAPID

| PAGE | 1 | 2 | 3 | 4 | 5 | 6 | 7 | 8 | 9 | 10 | ··· |
|---|---|---|---|---|---|---|---|---|---|---|---|
| INSPECTION | OK | OK | NG | NG | NG | NG | NG | NG | NG | NG | ··· |
| DETERMINATION | E | E | D | D | D | D | D | D | D | D | ··· |
| COMPLEMENT | OFF | OFF | OFF | ON | ON | ON | ON | ON | ON | ON | ··· |
| IMAGE DEFECT | OK | OK | NG | OK | OK | OK | OK | OK | OK | OK | ··· |

PRIOR ART

FIG. 17B

★ WHEN UNSTABLE NOZZLE IS PRESENT GOOD : RESISTANT TO UNSTABLE NOZZLE

| PAGE | 1 | 2 | 3 | 4 | 5 | 6 | 7 | 8 | 9 | 10 | ··· |
|---|---|---|---|---|---|---|---|---|---|---|---|
| INSPECTION | OK | OK | NG | OK | NG | OK | NG | OK | NG | OK | ··· |
| DETERMINATION | E | E | D | D | D | D | D | D | D | D | ··· |
| COMPLEMENT | OFF | OFF | OFF | ON | ON | ON | ON | ON | ON | ON | ··· |
| IMAGE DEFECT | OK | OK | NG | OK | OK | OK | OK | OK | OK | OK | ··· |

PRIOR ART

FIG. 17C

★ WHEN ERRONEOUS DETECTION IS SUSPECTED BAD : SUSCEPTIBLE TO ERRONEOUS DETECTION

| PAGE | 1 | 2 | 3 | 4 | 5 | 6 | 7 | 8 | 9 | 10 | ··· |
|---|---|---|---|---|---|---|---|---|---|---|---|
| INSPECTION | OK | OK | NG | OK | OK | OK | OK | OK | OK | OK | ··· |
| DETERMINATION | E | E | D | D | D | D | D | D | D | D | ··· |
| COMPLEMENT | OFF | OFF | OFF | ON | ON | ON | ON | ON | ON | ON | ··· |
| IMAGE DEFECT | OK | OK | OK | OK | OK | OK | OK | OK | OK | OK | ··· |

PRIOR ART

FIG. 18A

★ WHEN TRULY ABNORMAL NOZZLE IS PRESENT BAD : REACTION IS SLOW

| PAGE | 1 | 2 | 3 | 4 | 5 | 6 | 7 | 8 | 9 | 10 | ··· |
|---|---|---|---|---|---|---|---|---|---|---|---|
| INSPECTION | OK | OK | NG | NG | NG | NG | NG | NG | NG | NG | ··· |
| DETERMINATION | E | E | E | D | D | D | D | D | D | D | ··· |
| COMPLEMENT | OFF | OFF | OFF | OFF | ON | ON | ON | ON | ON | ON | ··· |
| IMAGE DEFECT | OK | OK | NG | NG | OK | OK | OK | OK | OK | OK | ··· |

PRIOR ART

FIG. 18B

★ WHEN UNSTABLE NOZZLE IS PRESENT BAD : SUSCEPTIBLE TO UNSTABLE NOZZLE

| PAGE | 1 | 2 | 3 | 4 | 5 | 6 | 7 | 8 | 9 | 10 | ··· |
|---|---|---|---|---|---|---|---|---|---|---|---|
| INSPECTION | OK | OK | NG | OK | NG | OK | NG | OK | NG | OK | ··· |
| DETERMINATION | E | E | E | E | E | E | E | E | E | E | ··· |
| COMPLEMENT | OFF | OFF | OFF | OFF | OFF | OFF | OFF | OFF | OFF | OFF | ··· |
| IMAGE DEFECT | OK | OK | NG | NG | NG | NG | NG | NG | NG | NG | ··· |

PRIOR ART

FIG. 18C

★ WHEN ERRONEOUS DETECTION IS SUSPECTED GOOD : RESISTANT TO ERRONEOUS DETECTION

| PAGE | 1 | 2 | 3 | 4 | 5 | 6 | 7 | 8 | 9 | 10 | ··· |
|---|---|---|---|---|---|---|---|---|---|---|---|
| INSPECTION | OK | OK | NG | OK | OK | OK | OK | OK | OK | OK | ··· |
| DETERMINATION | E | E | E | E | E | E | E | E | E | E | ··· |
| COMPLEMENT | OFF | OFF | OFF | OFF | OFF | OFF | OFF | OFF | OFF | OFF | ··· |
| IMAGE DEFECT | OK | OK | OK | OK | OK | OK | OK | OK | OK | OK | ··· |

PRIOR ART

FIG. 19A

★ WHEN TRULY ABNORMAL NOZZLE IS PRESENT GOOD : REACTION IS RAPID

| PAGE | 1 | 2 | 3 | 4 | 5 | 6 | 7 | 8 | 9 | 10 | ··· |
|---|---|---|---|---|---|---|---|---|---|---|---|
| INSPECTION | OK | OK | NG | NG | NG | NG | NG | NG | NG | NG | ··· |
| DETERMINATION | E | E | D | D | D | D | D | D | D | D | ··· |
| COMPLEMENT | OFF | OFF | OFF | ON | ON | ON | ON | ON | ON | ON | ··· |
| IMAGE DEFECT | OK | OK | NG | OK | OK | OK | OK | OK | OK | OK | ··· |

PRIOR ART

FIG. 19B

★ WHEN UNSTABLE NOZZLE IS PRESENT BAD : UNSTABLE NOZZLE IS OPENED

| PAGE | 1 | 2 | 3 | 4 | 5 | 6 | 7 | 8 | 9 | 10 | ··· |
|---|---|---|---|---|---|---|---|---|---|---|---|
| INSPECTION | OK | OK | NG | OK | NG | OK | NG | OK | NG | OK | ··· |
| DETERMINATION | E | E | D | E | D | E | D | E | D | E | ··· |
| COMPLEMENT | OFF | OFF | OFF | ON | OFF | ON | OFF | ON | OFF | ON | ··· |
| IMAGE DEFECT | OK | OK | NG | OK | NG | OK | NG | OK | NG | OK | ··· |

PRIOR ART

FIG. 19C

★ WHEN ERRONEOUS DETECTION IS SUSPECTED GOOD : RESISTANT TO ERRONEOUS DETECTION

| PAGE | 1 | 2 | 3 | 4 | 5 | 6 | 7 | 8 | 9 | 10 | ··· |
|---|---|---|---|---|---|---|---|---|---|---|---|
| INSPECTION | OK | OK | NG | OK | OK | OK | OK | OK | OK | OK | ··· |
| DETERMINATION | E | E | D | E | E | E | E | E | E | E | ··· |
| COMPLEMENT | OFF | OFF | OFF | ON | OFF | OFF | OFF | OFF | OFF | OFF | ··· |
| IMAGE DEFECT | OK | OK | OK | OK | OK | OK | OK | OK | OK | OK | ··· |

PRIOR ART

FIG. 20A

★ WHEN TRULY ABNORMAL NOZZLE IS PRESENT GOOD : REACTION IS RAPID

| PAGE | 1 | 2 | 3 | 4 | 5 | 6 | 7 | 8 | 9 | 10 | ··· |
|---|---|---|---|---|---|---|---|---|---|---|---|
| INSPECTION | OK | OK | NG | NG | NG | NG | NG | NG | NG | NG | ··· |
| DETERMINATION | E | E | D | D | D | D | D | D | D | D | ··· |
| COMPLEMENT | OFF | OFF | OFF | ON | ON | ON | ON | ON | ON | ON | ··· |
| IMAGE DEFECT | OK | OK | NG | OK | OK | OK | OK | OK | OK | OK | ··· |

FIG. 20B

★ WHEN UNSTABLE NOZZLE IS PRESENT GOOD : UNSTABLE NOZZLE CAN BE STOPPED

| PAGE | 1 | 2 | 3 | 4 | 5 | 6 | 7 | 8 | 9 | 10 | ··· |
|---|---|---|---|---|---|---|---|---|---|---|---|
| INSPECTION | OK | OK | NG | OK | NG | OK | NG | OK | NG | OK | ··· |
| DETERMINATION | E | E | D | E | D | D | D | D | D | D | ··· |
| COMPLEMENT | OFF | OFF | OFF | ON | OFF | ON | ON | ON | ON | ON | ··· |
| IMAGE DEFECT | OK | OK | NG | OK | NG | OK | OK | OK | OK | OK | ··· |

FIG. 20C

★ WHEN ERRONEOUS DETECTION IS SUSPECTED GOOD : RESISTANT TO ERRONEOUS DETECTION

| PAGE | 1 | 2 | 3 | 4 | 5 | 6 | 7 | 8 | 9 | 10 | ··· |
|---|---|---|---|---|---|---|---|---|---|---|---|
| INSPECTION | OK | OK | NG | OK | OK | OK | OK | OK | OK | OK | ··· |
| DETERMINATION | E | E | D | E | E | E | E | E | E | E | ··· |
| COMPLEMENT | OFF | OFF | OFF | ON | OFF | OFF | OFF | OFF | OFF | OFF | ··· |
| IMAGE DEFECT | OK | OK | OK | OK | OK | OK | OK | OK | OK | OK | ··· |

FIG. 21A

★ WHEN TRULY ABNORMAL NOZZLE IS PRESENT GOOD : REACTION IS RAPID

| PAGE | 1 | 2 | 3 | 4 | 5 | 6 | 7 | 8 | 9 | 10 | ··· |
|---|---|---|---|---|---|---|---|---|---|---|---|
| INSPECTION | OK | OK | NG | NG | NG | NG | NG | NG | NG | NG | ··· |
| DETERMINATION | E | E | D | D | D | D | D | D | D | D | ··· |
| COMPLEMENT | OFF | OFF | OFF | ON | ON | ON | ON | ON | ON | ON | ··· |
| IMAGE DEFECT | OK | OK | NG | OK | OK | OK | OK | OK | OK | OK | ··· |

FIG. 21B

★ WHEN UNSTABLE NOZZLE IS PRESENT GOOD : UNSTABLE NOZZLE CAN BE STOPPED

| PAGE | 1 | 2 | 3 | 4 | 5 | 6 | 7 | 8 | 9 | 10 | ··· |
|---|---|---|---|---|---|---|---|---|---|---|---|
| INSPECTION | OK | OK | NG | OK | NG | OK | NG | OK | NG | OK | ··· |
| DETERMINATION | E | E | D | D | D | D | D | D | D | D | ··· |
| COMPLEMENT | OFF | OFF | OFF | ON | ON | ON | ON | ON | ON | ON | ··· |
| IMAGE DEFECT | OK | OK | NG | OK | OK | OK | OK | OK | OK | OK | ··· |

FIG. 21C

★ WHEN ERRONEOUS DETECTION IS SUSPECTED GOOD : RESISTANT TO ERRONEOUS DETECTION

| PAGE | 1 | 2 | 3 | 4 | 5 | 6 | 7 | 8 | 9 | 10 | ··· |
|---|---|---|---|---|---|---|---|---|---|---|---|
| INSPECTION | OK | OK | NG | OK | OK | OK | OK | OK | OK | OK | ··· |
| DETERMINATION | E | E | D | D | D | D | D | E | E | E | ··· |
| COMPLEMENT | OFF | OFF | OFF | ON | ON | ON | ON | ON | OFF | OFF | ··· |
| IMAGE DEFECT | OK | OK | OK | OK | OK | OK | OK | OK | OK | OK | ··· |

FIG. 22A

★ WHEN TRULY ABNORMAL NOZZLE IS PRESENT GOOD : REACTION IS RAPID

| PAGE | ··· | 30 | 31 | 32 | 33 | 34 | 35 | 36 | 37 | 38 | 39 | 40 | 41 | 42 | 43 | 44 | 45 | 46 | ··· |
|---|---|---|---|---|---|---|---|---|---|---|---|---|---|---|---|---|---|---|---|
| INSPECTION | ··· | OK | OK | NG | NG | NG | NG | NG | NG | NG | NG | NG | NG | NG | NG | NG | NG | NG | ··· |
| DETERMINATION | ··· | E | E | D | D | D | D | D | D | D | D | D | D | D | D | D | D | D | ··· |
| COMPLEMENT | ··· | OFF | OFF | OFF | ON | ON | ON | ON | ON | ON | ON | ON | ON | ON | ON | ON | ON | ON | ··· |
| IMAGE DEFECT | ··· | OK | OK | NG | OK | OK | OK | OK | OK | OK | OK | OK | OK | OK | OK | OK | OK | OK | ··· |

FIG. 22B

★ WHEN UNSTABLE NOZZLE IS PRESENT GOOD : UNSTABLE NOZZLE CAN BE STOPPED

| PAGE | ··· | 30 | 31 | 32 | 33 | 34 | 35 | 36 | 37 | 38 | 39 | 40 | 41 | 42 | 43 | 44 | 45 | 46 | ··· |
|---|---|---|---|---|---|---|---|---|---|---|---|---|---|---|---|---|---|---|---|
| INSPECTION | ··· | OK | OK | NG | OK | NG | OK | NG | OK | NG | OK | NG | OK | NG | OK | NG | OK | NG | ··· |
| DETERMINATION | ··· | E | E | D | D | D | D | D | D | D | D | D | D | D | D | D | D | D | ··· |
| COMPLEMENT | ··· | OFF | OFF | OFF | ON | ON | ON | ON | ON | ON | ON | ON | ON | ON | ON | ON | ON | ON | ··· |
| IMAGE DEFECT | ··· | OK | OK | NG | OK | OK | OK | OK | OK | OK | OK | OK | OK | OK | OK | OK | OK | OK | ··· |

FIG. 22C

★ WHEN ERRONEOUS DETECTION IS SUSPECTED GOOD : RESISTANT TO ERRONEOUS DETECTION

| PAGE | … | 30 | 31 | 32 | 33 | 34 | 35 | 36 | 37 | 38 | 39 | 40 | 41 | 42 | 43 | 44 | 45 | 46 | … |
|---|---|---|---|---|---|---|---|---|---|---|---|---|---|---|---|---|---|---|---|
| INSPECTION | … | OK | OK | NG | OK | OK | OK | OK | OK | OK | OK | OK | OK | OK | OK | OK | OK | OK | … |
| DETERMINATION | … | E | E | D | D | D | D | D | D | D | D | D | D | E | E | E | E | E | … |
| COMPLEMENT | … | OFF | OFF | OFF | ON | ON | ON | ON | ON | ON | ON | ON | ON | ON | OFF | OFF | OFF | OFF | … |
| IMAGE DEFECT | … | OK | OK | OK | OK | OK | OK | OK | OK | OK | OK | OK | OK | OK | OK | OK | OK | OK | … |

FIG. 23A

★ WHEN TRULY ABNORMAL NOZZLE IS PRESENT GOOD : REACTION IS RAPID

| PAGE | ··· | 30 | 31 | 32 | 33 | 34 | 35 | 36 | 37 | 38 | 39 | 40 | 41 | 42 | 43 | 44 | 45 | 46 | ··· |
|---|---|---|---|---|---|---|---|---|---|---|---|---|---|---|---|---|---|---|---|
| INSPECTION | ··· | OK | OK | NG | NG | NG | NG | NG | NG | NG | NG | NG | NG | NG | NG | NG | NG | NG | ··· |
| DETERMINATION | ··· | E | E | D | D | D | D | D | D | D | D | D | D | D | D | D | D | D | ··· |
| COMPLEMENT | ··· | OFF | OFF | OFF | ON | ON | ON | ON | ON | ON | ON | ON | ON | ON | ON | ON | ON | ON | ··· |
| IMAGE DEFECT | ··· | OK | OK | NG | OK | OK | OK | OK | OK | OK | OK | OK | OK | OK | OK | OK | OK | OK | ··· |

FIG. 23B

★ WHEN UNSTABLE NOZZLE IS PRESENT GOOD : UNSTABLE NOZZLE CAN BE STOPPED

| PAGE | ··· | 30 | 31 | 32 | 33 | 34 | 35 | 36 | 37 | 38 | 39 | 40 | 41 | 42 | 43 | 44 | 45 | 46 | ··· |
|---|---|---|---|---|---|---|---|---|---|---|---|---|---|---|---|---|---|---|---|
| INSPECTION | ··· | OK | OK | NG | OK | NG | OK | NG | OK | NG | OK | NG | OK | NG | OK | NG | OK | NG | ··· |
| DETERMINATION | ··· | E | E | D | D | D | D | D | D | D | D | D | D | D | D | D | D | D | ··· |
| COMPLEMENT | ··· | OFF | OFF | OFF | ON | ON | ON | ON | ON | ON | ON | ON | ON | ON | ON | ON | ON | ON | ··· |
| IMAGE DEFECT | ··· | OK | OK | NG | OK | OK | OK | OK | OK | OK | OK | OK | OK | OK | OK | OK | OK | OK | ··· |

FIG. 23C

★ WHEN ERRONEOUS DETECTION IS SUSPECTED GOOD : RESISTANT TO ERRONEOUS DETECTION

| PAGE | … | 30 | 31 | 32 | 33 | 34 | 35 | 36 | 37 | 38 | 39 | 40 | … | 55 | 56 | 57 | 58 | … |
|---|---|---|---|---|---|---|---|---|---|---|---|---|---|---|---|---|---|---|
| INSPECTION | … | OK | OK | NG | OK | OK | OK | OK | OK | OK | OK | OK | … | OK | OK | OK | OK | … |
| DETERMINATION | … | E | E | D | D | D | D | D | D | D | D | D | … | D | D | E | E | … |
| COMPLEMENT | … | OFF | OFF | OFF | ON | ON | ON | ON | ON | ON | ON | ON | … | ON | ON | ON | OFF | … |
| IMAGE DEFECT | … | OK | OK | OK | OK | OK | OK | OK | OK | OK | OK | OK | … | OK | OK | OK | OK | … |

IMAGE RECORDING APPARATUS AND METHOD

CROSS-REFERENCE TO RELATED APPLICATIONS

The present application claims priority under 35 U.S.C. §119 to Japanese Patent Application No. 2014-174135, filed on Aug. 28, 2014. The above application is hereby expressly incorporated by reference, in its entirety, into the present application.

BACKGROUND OF THE INVENTION

1. Field of the Invention

The present invention relates to an image recording apparatus and method, and in particular, to an image recording apparatus and method for inspecting a print head during image recording.

2. Description of the Related Art

In a print head having recording elements arranged linearly or in a matrix, if there is abnormality in a recording element, image defect is generated in an image to be printed. For example, in a print head of an ink jet system (a marking system in which a liquid (ink) containing a coloring material and a functional material is separated into droplets, the droplets are ejected toward a recording object (medium) according to an image signal (print signal), and the coloring material and the functional material are attached and transmitted to the medium), if there is abnormality, such as non-ejection or failure in an ejection direction, in a nozzle as a recording element, image defect, such as stripes or unevenness, is generated in an image to be printed.

JP2014-91300A and JP2013-129112A describe a technique which inspects the state of each recording element during execution of a print job, prohibits the use of a recording element, in which abnormality is detected, and complements the abnormal recording element by another recording element.

JP1996-187881A (JP-H08-187881A) describes a technique which inspects the state of each recording element during execution of a print job, prohibits the use of a recording element, in which abnormality is detected, complements the abnormal recording element by another recording element, and when abnormality is eliminated, recovers the recording element to a normal operation.

JP2004-209460A describes a technique which determines the presence or absence of abnormality in a recording element, and when abnormality is determined twice in succession, recognizes that the recording element is abnormal.

SUMMARY OF THE INVENTION

In general, inspection of recording elements is performed based on a print result of a test chart. However, if the inspection is executed during execution of a print job, erroneous detection often occurs. In particular, if a print speed becomes faster, erroneous detection becomes conspicuous.

According to the methods of JP2014-91300A and JP2013-129112A, if abnormality is recognized once even at the time of erroneous detection, the use of the abnormal recording element is prohibited, and a complementary process is performed. Accordingly, it is disadvantageous in that the complementary process is performed more than necessary.

In contrast, according to the method of JP1996-187881A (JP-H08-187881A), if abnormality is eliminated, the recording element is recovered to the normal operation. Accordingly, a complementary process is not performed more than necessary; however, if there is an operationally unstable recording element, it is disadvantageous in that the complementary process is repeatedly started and stopped, and the operation is not stable.

The method of JP2004-209460A is resistant to erroneous detection; however, it is disadvantageous in that delay occurs in execution when a complementary process is truly required. Also, it is disadvantageous in that an unstable recording element cannot be captured.

The invention has been accomplished in consideration of this situation, and an object of the invention is to provide an image recording apparatus and method capable of appropriately executing a complementary process by appropriately determining the state of a recording element.

Means for solving the above-described problem is as follows.

(1) An image recording apparatus includes an inspection unit which inspects the presence or absence of abnormality in each recording element of a print head at regular intervals, a determination unit which determines the propriety of use of each recording element based on the inspection result of the inspection unit, and a complement unit which prohibits the use of a recording element determined to be disabled by the determination unit and complements image defect due to the use-prohibited recording element. The determination unit disables a recording element determined to have abnormality by inspection in the inspection unit during a determination period set in advance, if the disabled recording element is determined to have no abnormality by inspection immediately after the recording element is disabled, recovers the recording element to be enabled, and if the disabled recording element is determined to have abnormality again by inspection within a prescribed frequency N from inspection immediately after the recording element is disabled, continuously disables the recording element during the determination period.

According to this aspect, the presence or absence of abnormality in each recording element of the print head is inspected by the inspection unit at regular intervals. Then, the propriety of use of each recording element is determined by the determination unit based on the inspection result. If it is determined to be disabled by the determination unit, the use of the corresponding recording element is prohibited, image defect due to the use-prohibited recording element is complemented by the complement unit, and image recording is performed.

The determination unit disables a recording element determined to have abnormality by inspection in the inspection unit. If the recording element is disabled, a complementary process is performed by the complement unit. Therefore, it is possible to cope with abnormality quickly.

If the disabled recording element is determined to have no abnormality by immediately following inspection, the determination unit recovers the recording element to be enabled. With this, it is possible to prevent erroneous determination.

If the disabled recording element is determined to have abnormality again within N times from inspection immediately after the recording element is disabled, the determination unit continuously disables the recording element subsequently. Since the recording element is continuously disabled, subsequently, even when it is determined to be normal, the recording element is disabled. With this, it is possible to appropriately stop the use of an unstable recording element.

There is a high possibility that a truly abnormal recording element is determined to have abnormality even in immediately following inspection. In this case, the recording element is continuously disabled when it is determined to have abnormality by immediately following inspection; however, since the complementary process is already started, the complementary process is not delayed.

In this way, according to this aspect, the propriety of use of each recording element is determined in consideration of abnormality occurred in the past. With this, it is possible to appropriately determine the propriety of use of each recording element. Furthermore, when it is determined to be abnormal, the corresponding recording element is readily disabled, and thereafter, is recovered as necessary. Therefore, it is possible to quickly cope with a case where image complement is truly required.

The determination period can be determined based on, for example, the maintenance of the print head. For example, a period until the maintenance of the print head is executed next can be determined as the determination period. This is because there is a high possibility that the performance of the recording element is restored with the execution of the maintenance.

(2) An image recording apparatus includes an inspection unit which inspects the presence or absence of abnormality in each recording element of a print head at regular intervals, a determination unit which determines the propriety of use of each recording element based on the inspection result of the inspection unit, and a complement unit which prohibits the use of a recording element determined to be disabled by the determination unit and complements image defect due to the use-prohibited recording element. The determination unit disables a recording element determined to have abnormality by inspection in the inspection unit during a determination period set in advance, if the disabled recording element is determined to have no abnormality for a prescribed frequency M in succession from inspection immediately after the recording element is disabled, recovers the recording element to be enabled, and if the disabled recording element is determined to have abnormality again by inspection within a prescribed frequency N from inspection immediately after the recording element is disabled, continuously disables the recording element during the determination period.

According to this aspect, the presence or absence of abnormality in each recording element of the print head is inspected by the inspection unit at regular intervals. Then, the propriety of use of each recording element is determined by the determination unit based on the inspection result. If it is determined to be disabled by the determination unit, the use of the corresponding recording element is prohibited, image defect due to the use-prohibited recording element is complemented by the complement unit, and image recording is performed.

The determination unit disables a recording element determined to have abnormality by inspection in the inspection unit. If the recording element is disabled, a complementary process is performed by the complement unit. Therefore, it is possible to cope with abnormality quickly.

If the disabled recording element is determined to have no abnormality M times in succession from inspection immediately after the recording element is disabled, the determination unit recovers the recording element to be enabled. With this, it is possible to prevent erroneous determination.

If the disabled recording element is determined to have abnormality again within N times from inspection immediately after the recording element is disabled, the determination unit continuously disables the recording element subsequently. Since the recording element is continuously disabled, even if the recording element is determined to be normal in succession subsequently, the recording element is disabled. With this, it is possible to appropriately stop the use of an unstable recording element. Furthermore, even when abnormality occurs in succession, since the recording element is already disabled, the complementary process is not delayed.

In this way, according to this aspect, the propriety of use of each recording element is determined in consideration of abnormality occurred in the past. With this, it is possible to appropriately determine the propriety of use of each recording element. Furthermore, when it is determined to be abnormal, the corresponding recording element is readily disabled, and thereafter, is recovered as necessary. Therefore, it is possible to quickly cope with a case where image complement is truly required.

The determination period can be determined based on, for example, the maintenance of the print head. For example, a period until the maintenance of the print head is executed next can be determined as the determination period. This is because there is a high possibility that the performance of the recording element is restored with the execution of the maintenance.

(3) The image recording apparatus of (2) further includes an abnormality occurrence frequency count unit which counts a frequency K for which a recording element is determined to have abnormality by inspection in the inspection unit during an inspection period set in advance, and a prescribed frequency setting unit which sets the prescribed frequency M and the prescribed frequency N based on the frequency K counted by the abnormality occurrence frequency count unit. The prescribed frequency setting unit sets a number obtained by multiplying a number m set in advance by K as the prescribed frequency M and sets a number obtained by multiplying a number n set in advance by K as the prescribed frequency N.

According to this aspect, the frequency K for which the recording element is determined to be abnormal by inspection is counted. Then, the prescribed frequency M which becomes a determination criterion for whether or not to recover the recording element to be enabled is set based on the frequency K. Also, the prescribed frequency N which becomes a determination criterion for whether or not to continuously disable the recording element is set based on the frequency K. That is, according to this aspect, the prescribed frequency M and the prescribed frequency N are set based on the occurrence history of abnormality in the past. With this, it is possible to more appropriately set the recovery conditions.

(4) The image recording apparatus of (2) further includes an abnormality occurrence frequency count unit which counts a frequency K for which a recording element is determined to have abnormality by inspection in the inspection unit during an inspection period set in advance, and a prescribed frequency setting unit which sets the prescribed frequency M and the prescribed frequency N based on the frequency K counted by the abnormality occurrence frequency count unit. The prescribed frequency setting unit sets a number obtained by multiplying a number m set in advance by K-th power as the prescribed frequency M and sets a number obtained by multiplying a number n set in advance by K-th power as the prescribed frequency N.

According to this aspect, the frequency K for which the recording element is determined to be abnormal by inspection is counted. Then, the prescribed frequency M which becomes a determination criterion for whether or not to recover the recording element to be enabled is set based on the frequency K. Also, the prescribed frequency N which becomes a determination criterion for whether or not to continuously disable the recording element is set based on the frequency K. That is, according to this aspect, the prescribed frequency M and the prescribed frequency N are set based on the occurrence history of abnormality in the past. With this, it is possible to more appropriately set the recovery conditions.

(5) The image recording apparatus of any one of (1) to (4) further includes a notification unit which, in cases where the recording element is recovered from disabled to enabled, gives a notification indicating that the recording element is recovered from disabled to enabled, and in cases where the recording element is continuously disabled, gives a notification indicating that the recording element is continuously disabled.

According to this aspect, the notification indicating that the recording element is recovered from disabled to enabled and the notification indicating that the recording element is continuously disabled are given. With this, it is possible to recognize that there is an abnormal recording element and there is an unstable recording element.

(6) In the image recording apparatus of (5), the notification unit gives a notification by putting a stamp on a medium.

According to this aspect, the notification indicating that the recording element is recovered from disabled to enabled and the notification indicating that the recording element is continuously disabled are given by stamping.

(7) In the image recording apparatus of any one of (1) to (6), the print head records an image on a medium by a single pass.

According to this aspect, an image is recorded by the single pass. In the image recording apparatus in which an image is recorded by the single pass, an image is recorded at high speed. If an image is recorded at high speed, erroneous detection by the inspection unit is likely to occur. However, according to the image recording apparatus of any one of (1) to (6), even when erroneous detection occurs, it is possible to appropriately determine the propriety of use of each recording element and to appropriately execute image complement.

(8) In the image recording apparatus of any one of (1) to (7), the inspection unit inspects the presence or absence of abnormality in each recording element based on a test chart recorded on a medium.

According to this aspect, the test chart is recorded on the medium, and the presence or absence of abnormality in each recording element is inspected based on the recorded test chart.

(9) In the image recording apparatus of (8), the test chart is recorded for every one recording unit.

According to this aspect, the test chart is recorded for every one recording unit of an image on a medium. The terms "one recording unit" used herein refers to a recording unit of an image on a medium, and refers to a unit to be recognizable as single recording. Accordingly, for example, in cases where an image is recorded on a medium (for example, a paper sheet) of a sheet type (cut-form), recording of an image on one medium becomes one recording unit. In this case, a test chart is recorded each time an image is recorded on a medium. Furthermore, for example, in cases where an image is recorded on a continuous medium (for example, continuous paper), a unit of an image periodically recorded becomes one recording unit. In this case, a test chart is recorded between images periodically recorded.

According to this aspect, it is possible to quickly cope with a case where abnormality occurs in a recording element, and to prevent a medium from being wasted.

(10) In the image recording apparatus of any one of (1) to (9), the print head is an ink jet head and includes nozzles as the recording elements, and the inspection unit inspects the presence or absence of ejection abnormality in each nozzle.

According to this aspect, the print head is constituted by the ink jet head, and the presence or absence of ejection abnormality in each nozzle of the ink jet head is inspected by the inspection unit.

(11) In the image recording apparatus of (10), the complement unit prohibits the ejection of a nozzle determined to be disabled by the determination unit and complements image defect due to the ejection-prohibited nozzle.

According to this aspect, the ejection of a nozzle determined to be disabled is prohibited, and the nozzle is subjected to the complementary process. The complementary process is executed, for example, by increasing the droplet ejection amount of a nozzle near the ejection-prohibited nozzle.

(12) An image recording method of an image recording apparatus provided with an inspection unit which inspects the presence or absence of abnormality in each recording element of a print head at regular intervals includes disabling a recording element determined to have abnormality by inspection in the inspection unit during a determination period set in advance, if the disabled recording element is determined to have no abnormality by inspection immediately after the recording element is disabled, recovering the recording element to be enabled, if the disabled recording element is determined to have abnormality again by inspection within a prescribed frequency N from inspection immediately after the recording element is disabled, and continuously disabling the recording element during the determination period, and in cases where the recording element is disabled, prohibiting the use of the disabled recording element, complementing image defect due to the use-prohibited recording element, and recording an image.

According to this aspect, the presence or absence of abnormality in each recording element of the print head is inspected by the inspection unit at regular intervals. Then, the propriety of use of the recording element is determined based on the inspection result. As a result of the determination, if a recording element is disabled, the use of the recording element is prohibited. Then, image defect due to the use-prohibited recording element is complemented, and image recording is performed.

The determination disables a recording element determined to have abnormality by inspection in the inspection unit. If the recording element is disabled, the complementary process is performed by the complement unit. Therefore, it is possible to cope with abnormality quickly.

If the disabled recording element is determined to have no abnormality by immediately following inspection, the recording element is recovered to be enabled. With this, it is possible to prevent erroneous determination.

If the disabled recording element is determined to have abnormality again within N times from inspection immediately after the recording element is disabled, the recording element is continuously disabled subsequently. Since the recording element is continuously disabled, subsequently, even when it is determined to be normal, the recording element is disabled. With this, it is possible to appropriately stop the use of an unstable recording element.

There is a high possibility that a truly abnormal recording element is determined to have abnormality even in immediately following inspection. In this case, the recording element is continuously disabled when it is determined to have abnormality by immediately following inspection; however, since the complementary process is already started, the complementary process is not delayed.

In this way, according to this aspect, the propriety of use of each recording element is determined in consideration of abnormality occurred in the past. With this, it is possible to appropriately determine the propriety of use of each recording element. Furthermore, when it is determined to be abnormal, the corresponding recording element is readily disabled, and thereafter, is recovered as necessary. Therefore, it is possible to quickly cope with a case where image complement is truly required.

The determination period can be determined based on, for example, the maintenance of the print head. For example, a period until the maintenance of the print head is executed next can be determined as the determination period. This is because there is a high possibility that the performance of the recording element is restored with the execution of the maintenance.

(13) An image recording method of an image recording apparatus provided with an inspection unit which inspects the presence or absence of abnormality in each recording element of a print head at regular intervals includes disabling a recording element determined to have abnormality by inspection in the inspection unit during a determination period set in advance, if the disabled recording element is determined to have no abnormality for a prescribed frequency M in succession from inspection immediately after the recording element is disabled, recovering the recording element to be enabled, and if the disabled recording element is determined to have abnormality again by inspection within a prescribed frequency N from inspection immediately after the recording element is disabled, continuously disabling the recording element during the determination period, and in cases where the recording element is disabled, prohibiting the use of the disabled recording element, complementing image defect due to the use-prohibited recording element, and recording an image.

According to this aspect, the presence or absence of abnormality in each recording element of the print head is inspected by the inspection unit at regular intervals. Then, the propriety of use of each recording element is determined based on the inspection result. As a result of the determination, if a recording element is disabled, the use of the recording element is prohibited. Then, image defect due to the use-prohibited recording element is complemented, and image recording is performed.

The determination disables a recording element determined to have abnormality by inspection in the inspection unit. If the recording element is disabled, the complementary process is performed by the complement unit. Therefore, it is possible to cope with abnormality quickly.

If the disabled recording element is determined to have no abnormality M times in succession from inspection immediately after the recording element is disabled, the determination unit recovers the recording element to be enabled. With this, it is possible to prevent erroneous determination.

If the disabled recording element is determined to have abnormality again within N times from inspection immediately after the recording element is disabled, the recording element is continuously disabled subsequently. Since the recording element is continuously disabled, even if the recording element is determined to be normal in succession subsequently, the recording element is disabled. With this, it is possible to appropriately stop the use of an unstable recording element. Furthermore, even when abnormality occurs in succession, since the recording element is already disabled, the complementary process is not delayed.

In this way, according to this aspect, the propriety of use of each recording element is determined in consideration of abnormality occurred in the past. With this, it is possible to appropriately determine the propriety of use of each recording element. Furthermore, when it is determined to be abnormal, the corresponding recording element is readily disabled, and thereafter, is recovered as necessary. Therefore, it is possible to quickly cope with a case where image complement is truly required.

The determination period can be determined based on, for example, the maintenance of the print head. For example, a period until the maintenance of the print head is executed next can be determined as the determination period. This is because there is a high possibility that the performance of the recording element is restored with the execution of the maintenance.

(14) The image recording method of (13) further includes counting a frequency K for which a recording element is determined to have abnormality by inspection in the inspection unit during an inspection period set in advance, and setting a number obtained by multiplying a number m set in advance by K as the prescribed frequency M and setting a number obtained by multiplying a number n set in advance by K as the prescribed frequency N.

According to this aspect, the frequency K for which the recording element is determined to be abnormal by inspection is counted. Then, the prescribed frequency M which becomes a determination criterion for whether or not to recover the recording element to be enabled is set based on the frequency K. Also, the prescribed frequency N which becomes a determination criterion for whether or not to continuously disable the recording element is set based on the frequency K. That is, according to this aspect, the prescribed frequency M and the prescribed frequency N are set based on the occurrence history of abnormality in the past. With this, it is possible to more appropriately set the recovery conditions.

(15) The image recording method of (13) further includes counting a frequency K for which a recording element is determined to have abnormality by inspection in the inspection unit during an inspection period set in advance, and setting a number obtained by multiplying a number m set in advance by K-th power as the prescribed frequency M and setting a number obtained by multiplying a number n set in advance by K-th power as the prescribed frequency N.

According to this aspect, the frequency K for which the recording element is determined to be abnormal by inspection is counted. Then, the prescribed frequency M which becomes a determination criterion for whether or not to recover the recording element to be enabled is set based on the frequency K. Also, the prescribed frequency N which becomes a determination criterion for whether or not to continuously disable the recording element is set based on the frequency K. That is, according to this aspect, the prescribed frequency M and the prescribed frequency N are set based on the occurrence history of abnormality in the past. With this, it is possible to more appropriately set the recovery conditions.

(16) The image recording method of any one of (12) to (15) further includes, in cases where the recording element is recovered from disabled to enabled, giving a notification indicating that the recording element is recovered from disabled to enabled, and in cases where the recording element is continuously disabled, giving a notification indicating that the recording element is continuously disabled.

According to this aspect, the notification indicating that the recording element is recovered from disabled to enabled and the notification indicating that the recording element is continuously disabled are given. With this, it is possible to recognize that there is an abnormal recording element and there is an unstable recording element.

(17) In the image recording method of (15), a notification is given by putting a stamp on a medium.

According to this aspect, the notification indicating that the recording element is recovered from disabled to enabled and the notification indicating that the recording element is continuously disabled are given by stamping.

(18) In the image recording method of any one of (12) to (17), the print head records an image on a medium by a single pass.

According to this aspect, an image is recorded by the single pass. In the image recording apparatus in which an image is recorded by the single pass, an image is recorded at high speed. If an image is recorded at high speed, erroneous detection by the inspection unit is likely to occur. However, according to the image recording method of any one of (12) to (17), even when erroneous detection occurs, it is possible to appropriately determine the propriety of use of each recording element and to appropriately execute image complement.

(19) In the image recording method of any one of (12) to (18), the presence or absence of abnormality in each recording element is inspected based on a test chart recorded on a medium.

According to this aspect, the test chart is recorded on the medium, and the presence or absence of abnormality in each recording element is inspected based on the recorded test chart.

(20) In the image recording method of (19), the test chart is recorded for every one recording unit.

According to this aspect, the test chart is recorded for every one recording unit of an image on a medium. Accordingly, for example, when an image is recorded on a medium of a sheet, a test chart is recorded each time an image is recorded on a medium. Furthermore, for example, when an image is recorded on a continuous medium, a test chart is recorded between images. According to this aspect, it is possible to quickly cope with a case where abnormality occurs in a recording element, and to prevent a medium from being wasted.

(21) In the image recording method of any one of (12) to (20), the print head is an ink jet head and includes nozzles as the recording elements, and the presence or absence of ejection abnormality in each nozzle is inspected.

According to this aspect, the print head is constituted by the ink jet head, and the presence or absence of ejection abnormality in each nozzle of the ink jet head is inspected.

(22) In the image recording method of (21), the ejection of a nozzle determined to be disabled by the determination unit is prohibited and image defect due to the ejection-prohibited nozzle is complemented.

According to this aspect, the ejection of a nozzle determined to be disabled is prohibited, and the nozzle is subjected to the complementary process. The complementary process is executed, for example, by increasing the droplet ejection amount of a nozzle near the ejection-prohibited nozzle.

According to the invention, it is possible to appropriately execute a complementary process by appropriately determining the state of a recording element.

BRIEF DESCRIPTION OF THE DRAWINGS

FIGS. 17A to 17C are tables showing an execution situation of a complementary process and an occurrence situation of image defect when the propriety of use of each nozzle is determined by the determination method described in JP2014-91300A and JP2013-129112A.

FIGS. 18A to 18C are tables showing an execution situation of a complementary process and an occurrence situation of image defect when the propriety of use of each nozzle is determined by the determination method described in JP2004-209460A.

FIGS. 19A to 19C are tables showing an execution situation of a complementary process and an occurrence situation of image defect when the propriety of use of each nozzle is determined by the determination method described in JP1996-187881A (JP-H08-187881A).

FIGS. 20A to 20C are tables showing an execution situation of a complementary process and an occurrence situation of image defect when the propriety of use of each nozzle is determined by a determination method of a first embodiment.

FIGS. 21A to 21C are tables showing an execution situation of a complementary process and an occurrence situation of image defect when the propriety of use of each nozzle is determined by a determination method of a second embodiment.

FIGS. 22A to 22C are tables showing an execution situation of a complementary process and an occurrence situation of image defect when the propriety of use of each nozzle is determined by a determination method of a third embodiment.

FIGS. 23A to 23C are tables showing an execution situation of a complementary process and an occurrence situation of image defect when the propriety of use of each nozzle is determined by a determination method of a fourth embodiment.

DESCRIPTION OF THE PREFERRED EMBODIMENTS

Hereinafter, embodiments of the invention will be described in detail referring to the accompanying drawings.

<<Overall Configuration of Image Recording Apparatus>>

Figure 1:
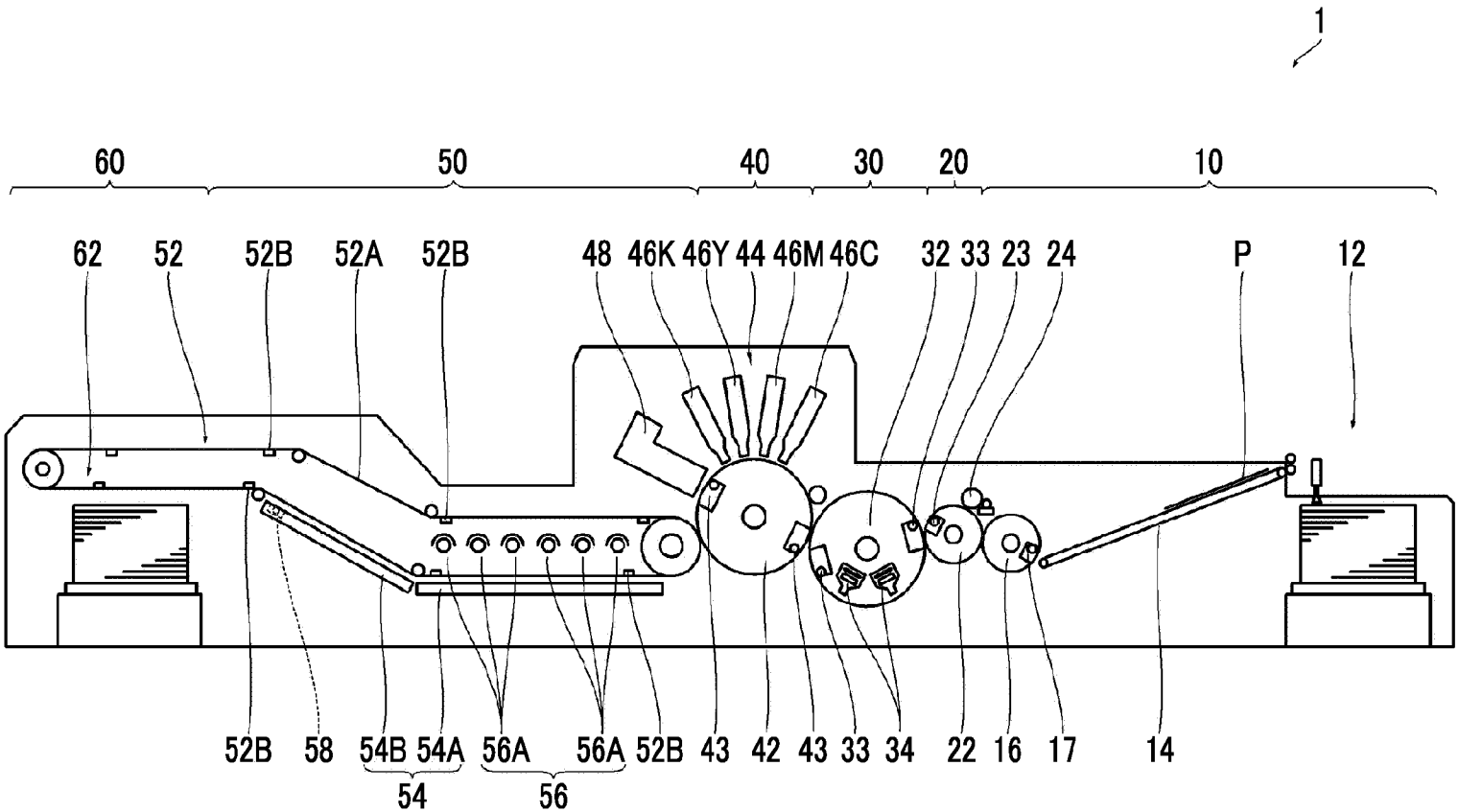
FIG. 1 is a side view showing the overall configuration of an ink jet printer.
Figure 2:
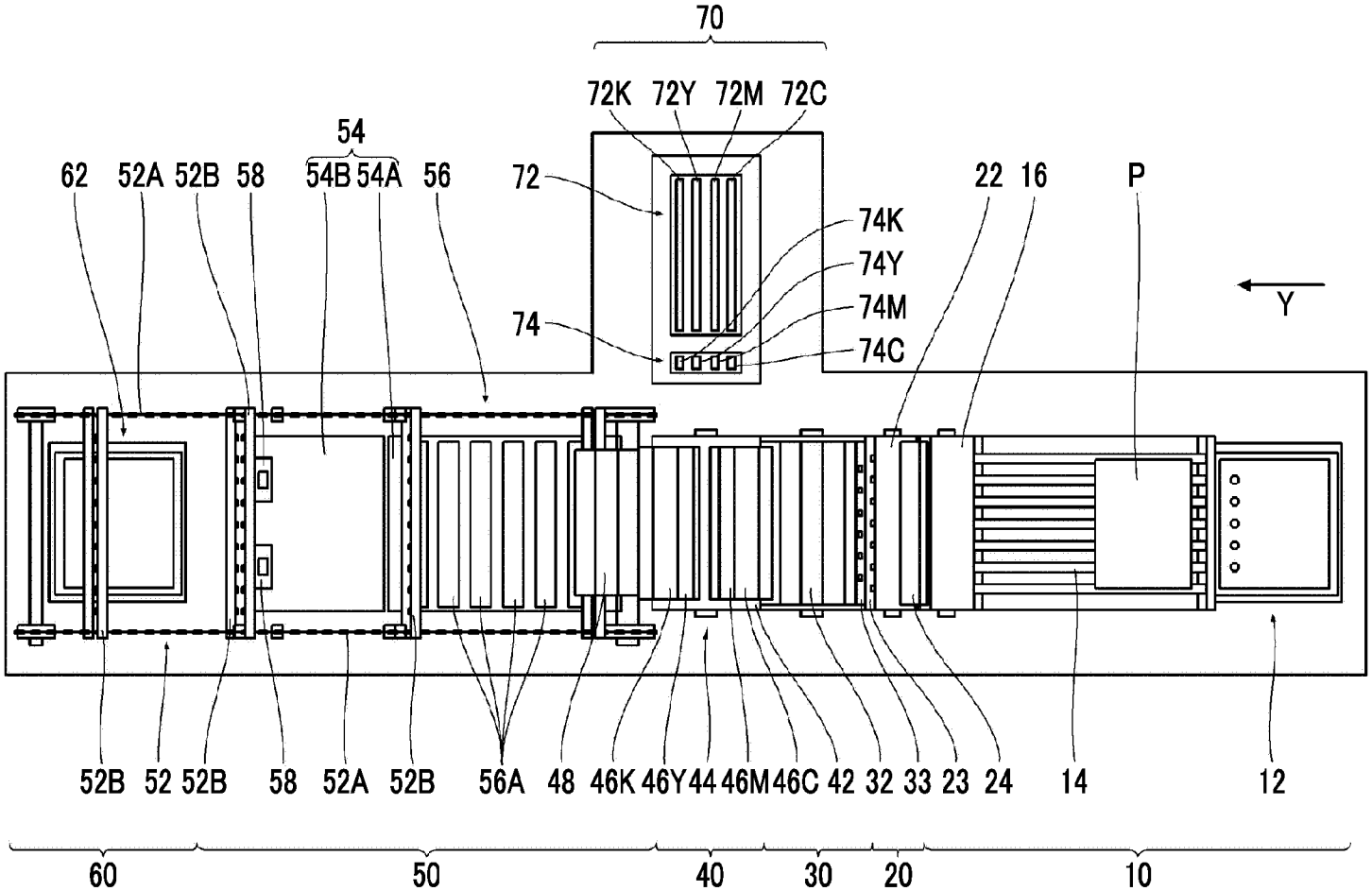
FIG. 2 is a plan view showing the overall configuration of an ink jet printer.

FIG. 1 is a side view showing the overall configuration of an ink jet printer which is an example of an image recording apparatus according to the invention. FIG. 2 is a plan view of the ink jet printer shown in FIG. 1.

The ink jet printer 1 is a sheet-type ink jet printer which prints (synonymous with "records") an image on a paper sheet (hereinafter, referred to as "sheet") as a medium by an ink jet system, and in particular, is a sheet-type color ink jet printer which prints a color image on a general-purpose printing sheet using water-based ink.

The general-purpose printing sheet refers to a sheet consisting essentially of cellulose, such as coated paper (art paper, coated paper, lightweight coated paper, cast paper, finely coated paper, or the like) used for offset printing or the like, not so-called paper exclusive for ink jet. Water-based ink refers to ink in which a coloring material, such as a dye or a pigment, is dissolved or dispersed in water and a solvent soluble in water.

As shown in FIGS. 1 and 2, the ink jet printer 1 is primarily provided with a sheet feed unit 10 which feeds a sheet P, a process liquid coating unit 20 which coats the sheet P fed from the sheet feed unit 10 with a predetermined process liquid, a process liquid drying unit 30 which dries the sheet P with the process liquid coated thereon, a printing unit 40 which prints the dried sheet P by an ink jet system, an ink drying unit 50 which dries the printed sheet P, an accumulation unit 60 which accumulates the dried sheet P, and a maintenance unit 70 which performs maintenance of an ink jet head in the printing unit 40.

<Sheet Feed Unit>

The sheet feed unit 10 feeds sheets (paper sheets) P as a medium one by one. As shown in FIGS. 1 and 2, the sheet feed unit 10 is primarily provided with a sheet feed device 12, a feeder board 14, and a sheet feed drum 16.

The sheet feed device 12 takes out the sheets P set at a predetermined position in a state of a sheet bundle in order from the top and feeds the sheets to the feeder board 14 one by one in order.

The feeder board 14 receives the sheet P sequentially fed from the sheet feed device 12, transports the received sheet P along a predetermined transport path, and transfers the sheet P to the sheet feed drum 16.

The sheet feed drum 16 receives the sheet P fed from the feeder board 14, transports the received sheet P along a predetermined transport path, and transfers the sheet P to the process liquid coating unit 20. The sheet feed drum 16 has a cylindrical shape, and transports the sheet P by rotating with the leading end of the sheet P gripped by grippers 17 provided on the peripheral surface and the sheet P wrapped around the peripheral surface.

<Process Liquid Coating Unit>

The process liquid coating unit 20 coats the sheet P with a predetermined process liquid. The process liquid is a liquid having a function of aggregating, insolubilizing, or thickening a coloring material component in ink. The sheet P is coated with the process liquid, whereby a high-quality image can be printed even when printing on a general-purpose printing sheet by an ink jet system.

As shown in FIGS. 1 and 2, the process liquid coating unit 20 is primarily provided with a process liquid coating drum 22 which transports the sheet P, and a process liquid coating device 24 which coats the sheet P transported by the process liquid coating drum 22 with the process liquid.

The process liquid coating drum 22 receives the sheet P from the sheet feed drum 16 of the sheet feed unit 10, transports the received sheet P along a predetermined transport path, and transfers the sheet P to the process liquid drying unit 30. The process liquid coating drum 22 has a cylindrical shape, and transports the sheet P by rotating with the end portion of the sheet P on the front side in the transport direction by grippers 23 provided on the peripheral surface and the sheet P wrapped around the peripheral surface.

The process liquid coating device 24 is provided on the transport path of the sheet P by the process liquid coating drum 22, and roller-coats the sheet P transported by the process liquid coating drum 22 with the process liquid. That is, a roller (so-called coating roller) with the process liquid applied to the peripheral surface is brought into contact with the sheet P transported by the process liquid coating drum 22, thereby coating the sheet P with the process liquid. A coating system of the process liquid is not limited thereto, and a coating system using an ink jet head, a coating system using a spray, or the like may be used.

The process liquid coating unit 20 is configured as above. In the process of transporting the sheet P by the process liquid coating drum 22, a printing surface, that is, a surface on which an image is printed is coated with the process liquid.

<Process Liquid Drying Unit>

The process liquid drying unit 30 dries the sheet P coated with the process liquid. The process liquid drying unit 30 is primarily provided with a process liquid drying drum 32 which transports the sheet P, and a process liquid drying device 34 which dries the sheet P by blowing hot air toward the sheet P transported by the process liquid drying drum 32.

The process liquid drying drum 32 receives the sheet P from the process liquid coating drum 22 of the process liquid coating unit 20, transports the received sheet P along a predetermined transport path, and transfers the sheet P to the printing unit 40. The process liquid drying drum 32 is constituted by a cylindrical shaped frame body, and transports the sheet P by rotating with the end portion of the sheet P on the front side in the transport direction gripped by grippers 33 provided on the peripheral surface.

The process liquid drying device 34 is provided inside the process liquid drying drum 32, and blows hot air toward the sheet P transported by the process liquid drying drum 32.

The process liquid drying unit 30 is configured as above. In a process of the sheet P being transported by the process liquid drying drum 32, the sheet P is dried by blowing hot air toward the surface coated with the process liquid.

<Printing Unit>

The printing unit 40 prints a color image on the sheet P using ink of four colors of cyan (C), magenta (M), yellow (Y), and black (K). As shown in FIG. 1, the printing unit 40 is primarily provided with a printing drum 42 which transports the sheet P, a head unit 44 which performs color printing on the sheet P transported by the printing drum 42, and a scanner 48 which reads an image printed on the sheet P.

The printing drum 42 receives the sheet P from the process liquid drying drum 32 of the process liquid drying unit 30, transports the received sheet P along a predetermined transport path, and transfers the sheet P to the ink drying unit 50. The printing drum 42 has a cylindrical shape, and transports the sheet P by rotating with the leading end of the sheet P gripped by grippers 43 provided on the peripheral surface and the sheet P wrapped around the peripheral surface. The printing drum 42 transports the sheet P wrapped around the peripheral surface while being suction-retained on the peripheral surface. For suction retention, negative pressure is used. The printing drum 42 has multiple suction holes in the peripheral surface, and holds the sheet P in a state of being sucked to the peripheral surface by the suction from the inside through the suction holes. The sheet P may be held on the peripheral surface using electrostatic attraction.

The head unit 44 is provided on the transport path of the sheet P by the printing drum 42, and prints a color image on the sheet P transported by the printing drum 42 using ink of four colors of cyan, magenta, yellow, and black. The head unit 44 is provided with an ink jet head 46C which ejects ink droplets of cyan, an ink jet head 46M which ejects ink droplets of magenta, an ink jet head 46Y which ejects ink droplets of yellow, and an ink jet head 46K which ejects ink droplets of black. The respective ink jet heads 46C, 46M, 46Y, and 46K are an example of a print head, and are arranged at regular intervals on the transport path of the sheet P by the printing drum 42. The ink jet heads 46C, 46M, 46Y, and 46K are mounted in a carriage (not shown), and constitute one head unit 44. The carriage is provided to be movable between the printing unit 40 and the maintenance unit 70.

Each of the ink jet heads 46C, 46M, 46Y, and 46K is constituted by a line head which can record an image on the sheet P transported by the printing drum 42 with a single pass. Each of the ink jet heads 46C, 46M, 46Y, and 46K is provided with a nozzle surface at the leading end, and ejects ink droplets from nozzles provided in the nozzle surface toward the sheet P transported by the printing drum 42.

Figure 3:
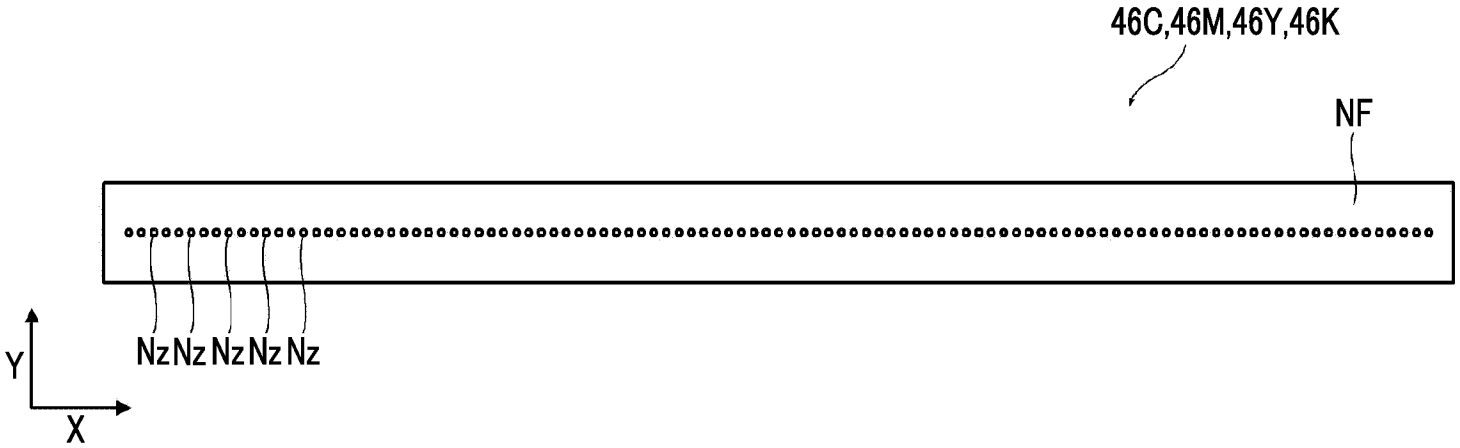
FIG. 3 is a plan view of a nozzle surface.

FIG. 3 is a plan view of a nozzle surface.

As shown in FIG. 3, nozzles Nz are arranged in a row at regular intervals in a nozzle surface NF. An arrangement direction X of the nozzles Nz is a direction orthogonal to a transport direction Y of the sheet P by the printing drum 42.

The ink jet heads 46C, 46M, 46Y, and 46K eject ink droplets from the nozzles toward the sheet P to draw an image on the sheet P. In this way, when a print head is constituted by an ink jet head, each nozzle constitutes a recording element of a print head.

The scanner 48 reads an image printed on the sheet P by the ink jet heads 46C, 46M, 46Y, and 46K. Accordingly, as shown in FIG. 1, the scanner 48 is provided on the transport path of the sheet P by the printing drum 42, and is arranged on the downstream side of the head unit 44 with respect to the transport direction of the sheet P.

The printing unit 40 is configured as above. In a process of the sheet P being transported by the printing drum 42, ink droplets of the respective colors of C, M, Y, and K are ejected from the ink jet heads 46C, 46M, 46Y, and 46K constituting the head unit 44 onto the printing surface, and a color image is printed on the printing surface. The image printed on the sheet P is read by the scanner 48 as necessary.

<Ink Drying Unit>

The ink drying unit 50 dries the sheet P immediately after printing by the printing unit 40. As shown in FIGS. 1 and 2, the ink drying unit 50 is primarily provided with a chain gripper 52 which transports the sheet P, a sheet guide 54 which guides the traveling of the sheet P transported by the chain gripper 52, and a heating drying device 56 which heats and dries the printing surface of the sheet P transported by the chain gripper 52.

The chain gripper 52 receives the sheet P from the printing drum 42 of the printing unit 40, transports the received sheet P along a predetermined transport path, and transfers the sheet P to the accumulation unit 60. The chain gripper 52 is provided with an endless chain 52A which travels along a given traveling path, and transports the sheet P with the leading end of the sheet P gripped by grippers 52B provided in the chain 52A. The sheet P is transported to the chain gripper 52, whereby the sheet P passes through a heating area and a non-heating area set in the ink drying unit 50 and is transferred to the accumulation unit 60. The heating area is set in an area where the sheet P transferred from the printing unit 40 is transported horizontally for the first time, and the non-heating area is set in an area where the sheet P is transported in an inclined state.

The sheet guide 54 guides the movement of the sheet P transported by the chain gripper 52. The sheet guide 54 is provided with a first guide board 54A and a second guide board 54B.

The first guide board 54A is a guide board which is arranged in the heating area, and has a hollow flat plate shape. An upper surface portion of the first guide board 54A becomes a guide surface of the sheet P. The sheet P is transported while sliding on the guide surface.

The guide surface of the first guide board 54A is provided with multiple suction holes. The first guide board 54A guides the movement of the sheet P with the sheet P sucked to the guide surface by the negative pressure suction from the inside through the suction holes.

The second guide board 54B is a guide board which is arranged in the non-heating area. The configuration of the second guide board 54B is the same as the configuration of the first guide board 54A. That is, the second guide board 54B has a hollow flat plate shape, and guides the movement of the sheet P with the sheet P sucked to the guide surface.

The second guide board 54B is provided with a stamp device 58 at the terminal position of the movement path of the sheet P. The stamp device 58 is provided with a stamp roller, and the stamp roller is brought into contact with the sheet P to put a stamp on the sheet P. The stamp roller is provided to be retractable from the guide surface of the second guide board 54B, and protrudes from the guide surface to put a stamp on the sheet P moving on the guide surface.

The heating drying device 56 is arranged in the heating area, and heats and dries the printing surface of the sheet P transported through the heating area by radiant heat from a heat source. The heating drying device 56 is provided with a plurality of infrared ray lamps 56A as a heat source, and is arranged inside the chain gripper 52. The infrared ray lamps 56A are arranged at regular intervals along the transport path of the sheet P in the heating area.

The ink drying unit 50 is configured as above. In a process of the sheet P being transported by the chain gripper 52, the printing surface is heated by the heating drying device 56 and dried.

<Accumulation Unit>

The accumulation unit 60 accumulates the sheets P sequentially discharged in one place. As shown in FIGS. 1 and 2, the accumulation unit 60 is provided with an accumulation device 62 which receives and accumulates the sheet P transported from the ink drying unit 50 by the chain gripper 52.

The chain gripper 52 releases the sheet P at a predetermined accumulation position. The accumulation device 62 collects the released sheet P and accumulates the sheet P in a bundle form.

<Maintenance Unit>

The maintenance unit 70 performs maintenance of the ink jet heads 46C, 46M, 46Y, and 46K provided in the printing unit 40. As shown in FIG. 2, the maintenance unit 70 is primarily provided with a cap device 72 which covers the nozzle surfaces of the ink jet heads 46C, 46M, 46Y, and 46K with caps, and a cleaning device 74 which cleans the nozzle surfaces of the ink jet heads 46C, 46M, 46Y, and 46K by wiping.

The cap device 72 is provided with caps 72C, 72M, 72Y, and 72K for the ink jet heads 46C, 46M, 46Y, and 46K. The caps 72C, 72M, 72Y, and 72K separately covers the nozzle surfaces of the ink jet heads 46C, 46M, 46Y, and 46K.

Capping is performed by moving the ink jet heads 46C, 46M, 46Y, and 46K to a predetermined cap position. As described above, the ink jet heads 46C, 46M, 46Y, and 46K are movably mounted in the carriage. The ink jet heads 46C, 46M, 46Y, and 46K are moved to the cap position by moving the carriage.

The carriage is provided to be movable horizontally along the rotational axis of the printing drum 42. The ink jet heads 46C, 46M, 46Y, and 46K are provided to be movable between the cap position and the printing position by the movement of the carriage. The ink jet heads 46C, 46M, 46Y, and 46K are positioned at the printing position, and are thus arranged on the transport path of the sheet P by the printing drum 42. Also, the ink jet heads 46C, 46M, 46Y, and 46K are positioned at the cap position, and are thus arranged directly on the caps 72C, 72M, 72Y, and 72K.

The carriage is provided with an ascending and descending mechanism which ascends and descends the ink jet heads 46C, 46M, 46Y, and 46K in a direction perpendicular to the nozzle surface. The ink jet heads 46C, 46M, 46Y, and 46K positioned at the cap position descend by the ascending and descending mechanism, whereby the nozzle surfaces are covered with the caps 72C, 72M, 72Y, and 72K.

The cleaning device 74 is provided with cleaners 74C, 74M, 74Y, and 74K which separately cleans the nozzle surfaces of the ink jet heads 46C, 46M, 46Y, and 46K. Each of the cleaners 74C, 74M, 74Y, and 74K is provided with a wiping member which wipes the nozzle surface. The wiping member is constituted by, a blade or a web, and is provided to advance and retreat to and from the nozzle surface. The cleaning device 74 is arranged on the movement path of the ink jet heads 46C, 46M, 46Y, and 46K by the carriage. In a process of each of the ink jet heads 46C, 46M, 46Y, and 46K being moved from the cap position to the printing position by the carriage, the wiping member is brought into press contact with the nozzle surface, whereby the nozzle surface is wiped.

The maintenance unit 70 is configured as above. As described above, capping by the cap device 72 is performed by moving the ink jet heads 46C, 46M, 46Y, and 46K to the cap position. The ink jet heads 46C, 46M, 46Y, and 46K are moved to the cap position and then descend to a predetermined position, whereby the nozzle surfaces are covered with the caps 72C, 72M, 72Y, and 72K. Capping is executed when the use of the ink jet heads 46C, 46M, 46Y, and 46K is stopped for a given time or more, such as at the time of power-off or during standby. Purging or preliminary ejection (also referred to as flushing) as one of maintenance is performed with the cap device 72.

Cleaning of the nozzle surface by the cleaning device 74 is performed by moving the ink jet heads 46C, 46M, 46Y, and 46K from the cap position to the printing position. The cleaners 74C, 74M, 74Y, and 74K provided in the cleaning device 74 bring the wiping members into press contact with the nozzle surfaces of the ink jet heads 46C, 46M, 46Y, and 46K moving from the cap position toward the printing position, thereby wiping the nozzle surfaces with the wiping members.

Maintenance is automatically executed at a timing set in advance. Also, maintenance is forcibly executed according to an instruction from an operator. In regard to maintenance which is automatically performed, the execution timing is prescribed for each kind of maintenance. The execution timing is prescribed by, for example, the elapsed time from previous maintenance, the number of printed sheets, or the like.

<<Control System>>

(System Configuration)

Figure 4:
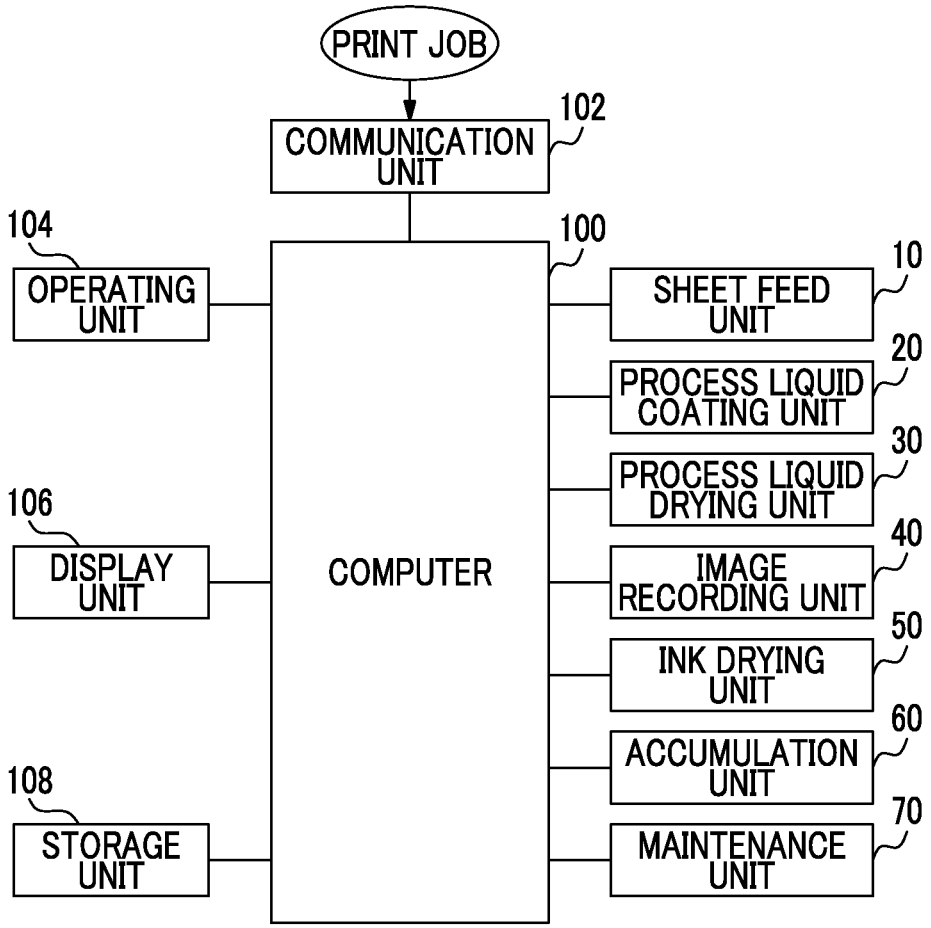
FIG. 4 is a block diagram showing the system configuration of an ink jet printer.

FIG. 4 is a block diagram showing the system configuration of the ink jet printer.

As shown in FIG. 4, the ink jet printer 1 is provided a computer 100 as a control unit. The entire operation of the ink jet printer 1 is controlled by the computer 100. That is, all processes of sheet feed from the sheet feed unit 10, transportation of the fed sheet P, coating of the process liquid in the process liquid coating unit 20, drying of the sheet P in the process liquid drying unit 30, printing of an image in the printing unit 40, reading of the printed image, drying of the sheet P in the ink drying unit 50, discharge of the sheet P, accumulation of the sheet P in the accumulation unit 60, and the like are executed under the control of the computer 100. Also, maintenance is executed under the control of the computer 100.

The computer 100 executes a predetermined control program to function as a control unit which controls the respective units of the ink jet printer 1.

To the computer 100 are connected a communication unit 102 which performs communication with an external apparatus, an operating unit 104 which operates the ink jet printer 1, a display unit 106 which displays various kinds of information, a storage unit 108 which stores various kinds of data, and the like.

The operating unit 104 can be constituted by, for example, operation buttons, a keyboard, a mouse, a touch panel, and the like. The display unit 106 can be constituted by, for example, a display device, such as a liquid crystal display. The storage unit 108 can be constituted by, for example, a storage device, such as a hard disk drive. A control program executed by the computer 100, various kinds of data necessary for control, and the like are stored in the storage unit 108. A print job is loaded on the computer 100 through the communication unit 102.

The computer 100 executes a predetermined image processing program, thereby functioning as an image processing unit.

Figure 5:
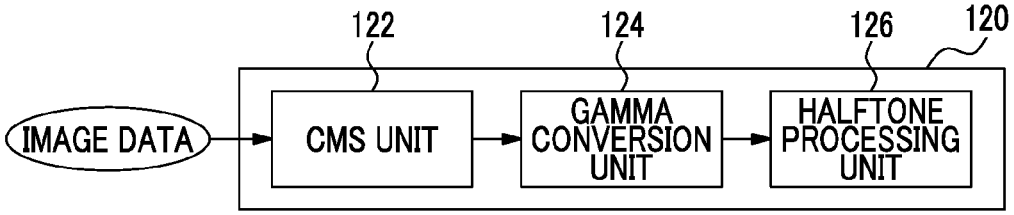
FIG. 5 is a functional block diagram of a computer which functions as an image processing unit.

FIG. 5 is a functional block diagram of a computer which functions as an image processing unit.

The image processing unit 120 performs a conversion process of image data. That is, image data to be printed in a print job is converted in a data format processable in the ink jet printer 1. Specifically, image data (for example, image data expressed in an RGB format) to be printed is converted into dot arrangement data of the respective colors of cyan (C), magenta (M), yellow (Y), and black (K).

The image processing unit 120 is provided with a CMS (color management system) unit 122, a gamma conversion unit 124, and a halftone processing unit 126.

The CMS unit 122 executes a color matching process for matching the color of input image data with a target, and executes a process (3-4 conversion (RGB-CMYK) or 4-4 conversion (CMYK-CMYK)) for decomposing image data into four colors of C, M, Y, and K as ink colors to be used. With this, the monochromatic gradations of CMYK are obtained.

The gamma conversion unit 124 executes a calibration process on image data of CMYK for each color, and performs adjustment (gamma conversion) of output characteristics.

The halftone processing unit 126 executes a halftone process on color data of each color subjected to gamma conversion using an error diffusion method or a dither matrix method, and produces dot arrangement data of each color.

At the time of printing, the computer 100 ejects ink droplets from the ink jet heads 46C, 46M, 46Y, and 46K based on the produced dot arrangement data, thereby printing an image on the sheet P.

The computer 100 executes a predetermined inspection program, thereby functioning as an inspection unit 130 which inspects the presence or absence of abnormality in each nozzle of each of the ink jet heads 46C, 46M, 46Y, and 46K.

The computer 100 executes a predetermined determination program, thereby functioning as a determination unit 132 which determines the propriety of use of each nozzle in each of the ink jet heads 46C, 46M, 46Y, and 46K. The computer 100 executes a predetermined image complementary program, thereby functioning as a complement unit 134 which complements image defect due to a disabled nozzle.

Figure 6:
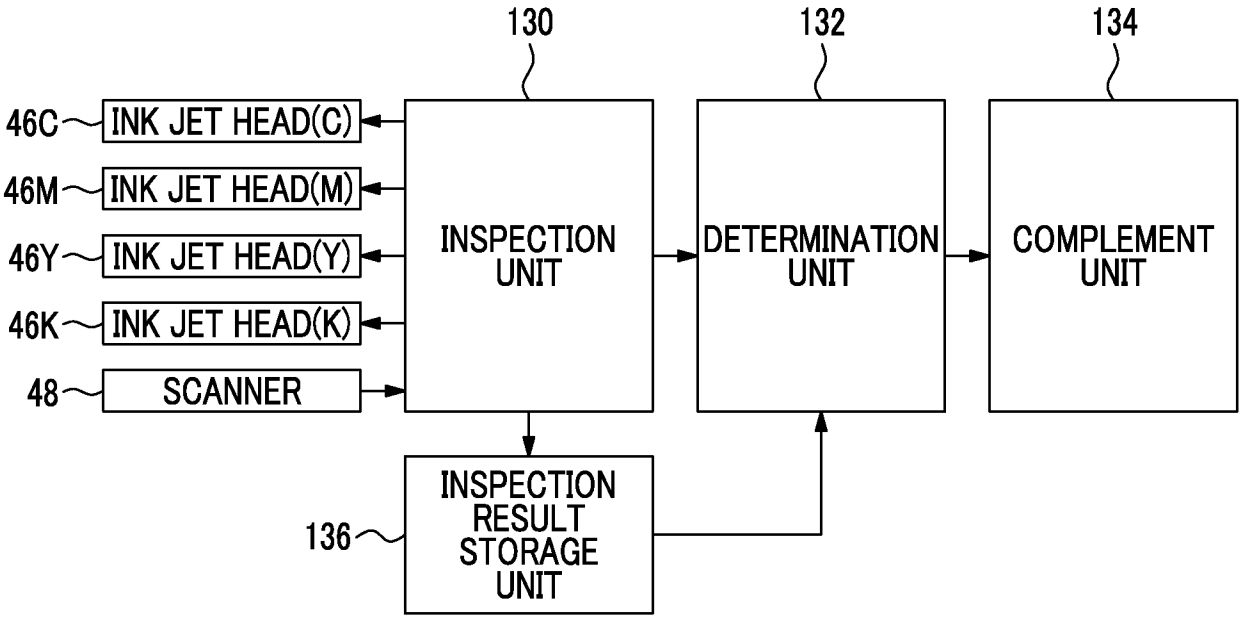
FIG. 6 is a functional block diagram of a computer which functions as an inspection unit, a determination unit, and a complement unit.

FIG. 6 is a functional block diagram of a computer which functions as an inspection unit, a determination unit, and a complement unit.

The inspection unit 130 causes the ink jet heads 46C, 46M, 46Y, and 46K to print a predetermined test chart, and inspects the presence or absence of abnormality in each nozzle as a recording element, that is, the presence or absence of ejection abnormality based on the output result of the test chart. That is, a predetermined test chart is printed by the ink jet heads 46C, 46M, 46Y, and 46K, an image of the printed test chart is read by the scanner 48, and the obtained image of the test chart is analyzed, thereby inspecting the presence or absence of ejection abnormality in each nozzle.

Figure 7:
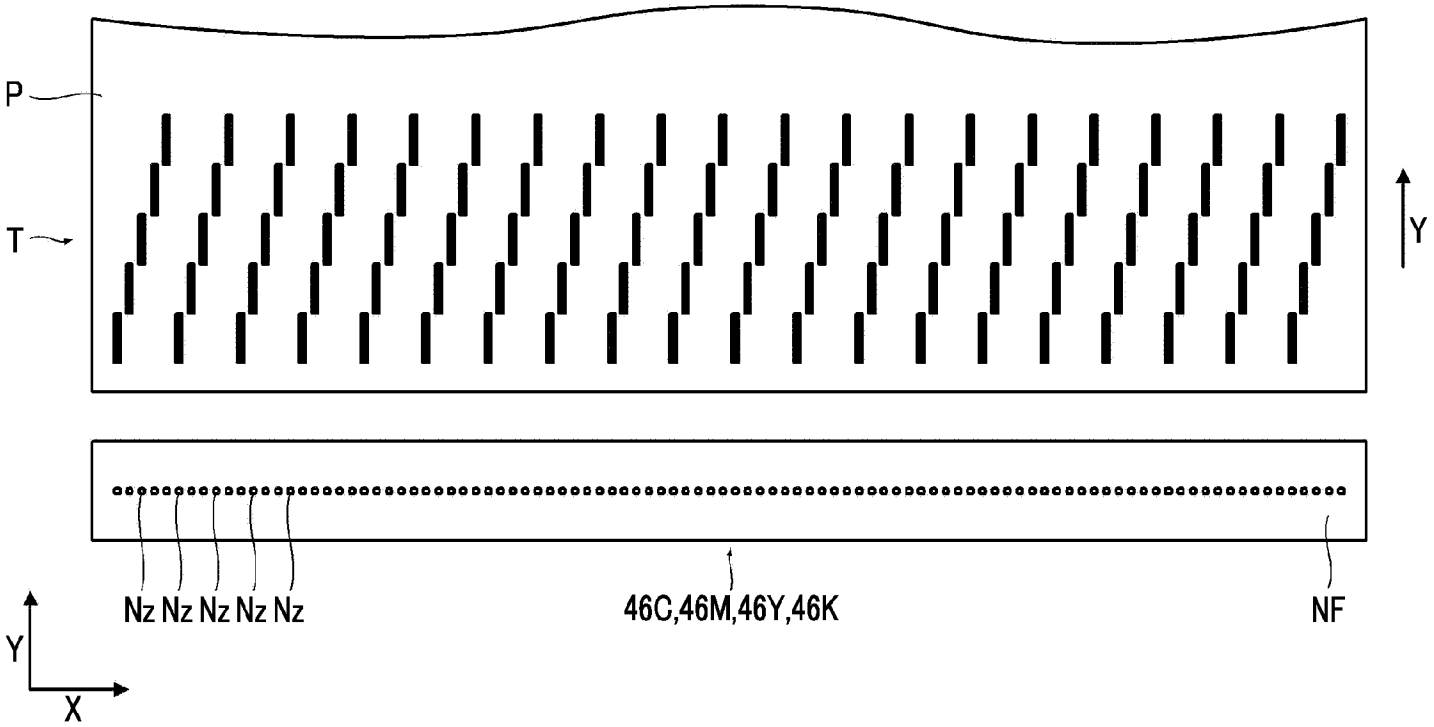
FIG. 7 is a diagram showing an example of a test chart.
Figure 8:
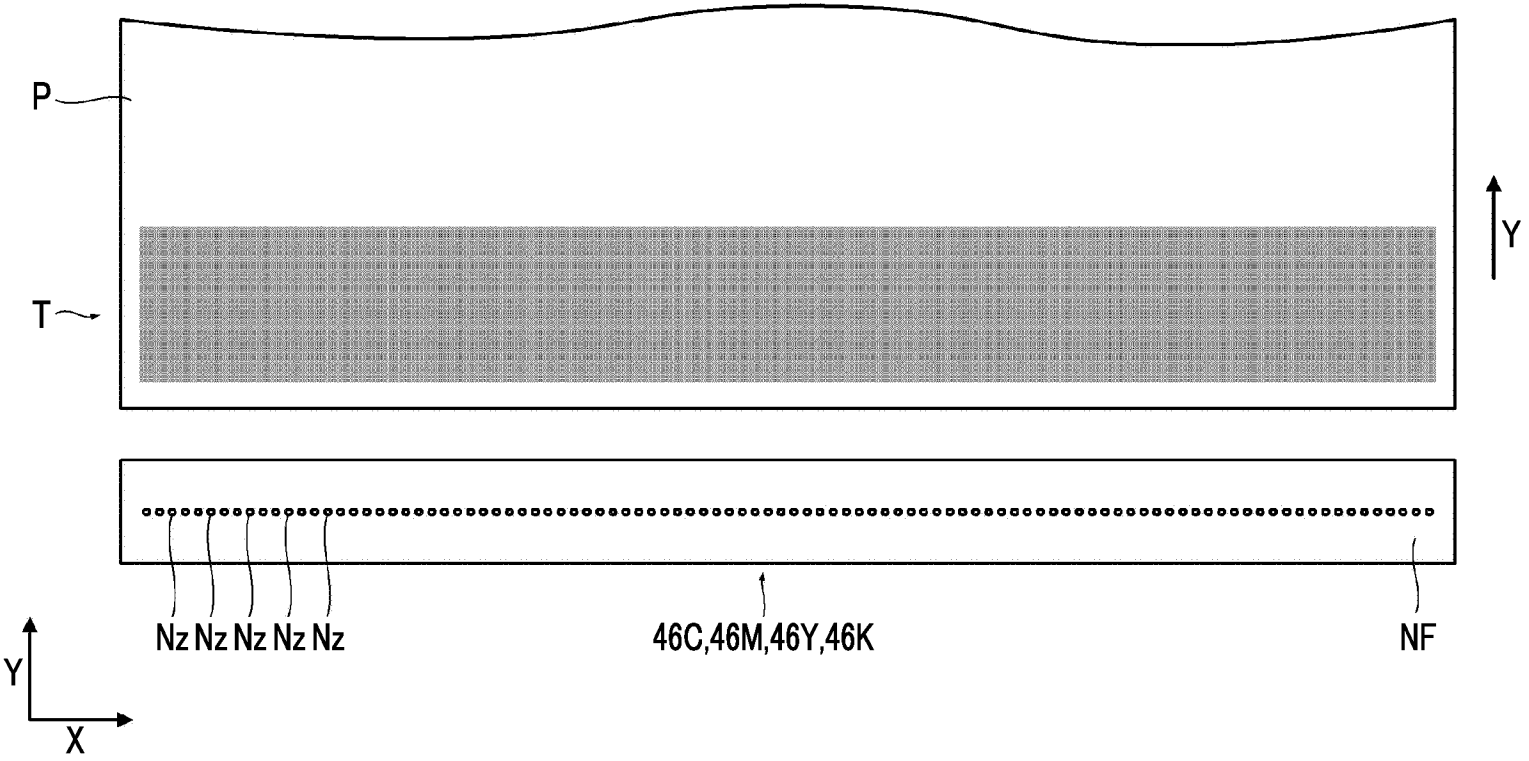
FIG. 8 is a diagram showing an example of a test chart.

FIGS. 7 and 8 are diagrams showing an example of a test chart. FIGS. 9A and 9B and FIGS. 10A and 10B are conceptual diagram of a nozzle inspection method using a test chart.

As a test chart T, any test chart may be used as long as abnormality in each nozzle Nz can be detected. For example, as shown in FIG. 7, a test chart T in a nozzle check pattern (droplets are ejected from respective nozzles in a stepwise manner), as shown in FIG. 8, an isodensity patch (a patch having uniform density is ejected from each nozzle), or the like can be used. As the test chart T, a nozzle check pattern shown in FIG. 7 or the isodensity patch shown in FIG. 8 is used, whereby non-ejection or failure in the ejection direction can be detected.

Figure 9B:
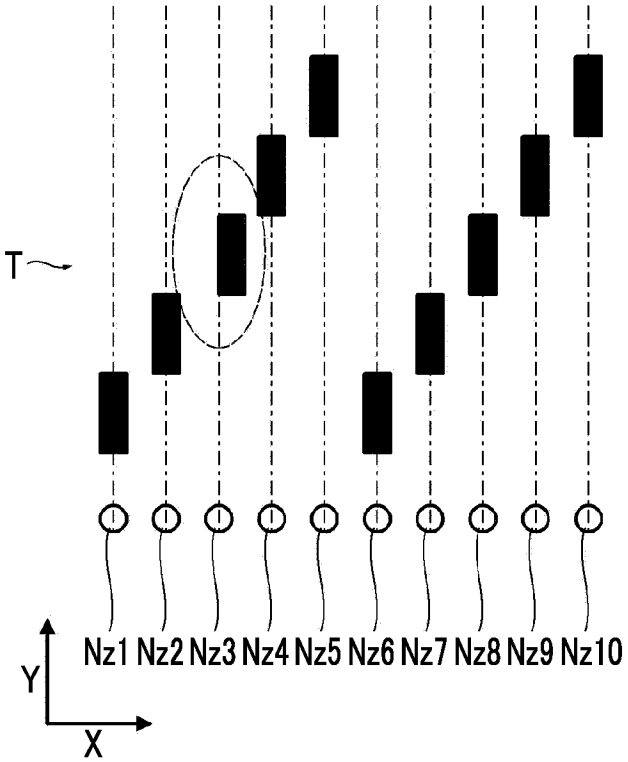
FIGS. 9A and 9B are conceptual diagrams of a nozzle inspection method using a test chart.
Figure 9A:
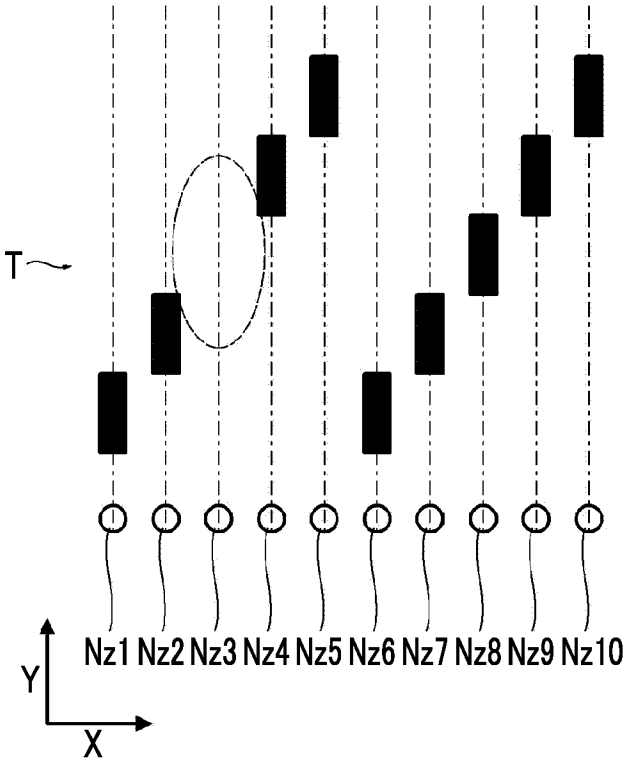

For example, when the nozzle check pattern shown in FIG. 7 is used, if a nozzle is placed in a non-ejection state, as shown in FIG. 9A, the pattern of the non-ejection nozzle (in this case, a third nozzle Nz3 from the left of FIG. 9A) is not printed. Accordingly, a pattern which is not printed is detected, whereby a non-ejection nozzle can be detected.

When the nozzle check pattern shown in FIG. 7 is used, if failure in the ejection direction occurs in a nozzle, as shown in FIG. 9B, the pattern of the nozzle (in this case, a third nozzle Nz3 from the left of FIG. 9B) with failure in the ejection direction is printed deviated from a normal position (a position printed when failure in the ejection direction does not occur). Accordingly, a pattern printed deviated from the normal position is detected, whereby a nozzle with failure in the ejection direction can be detected.

Figure 10B:
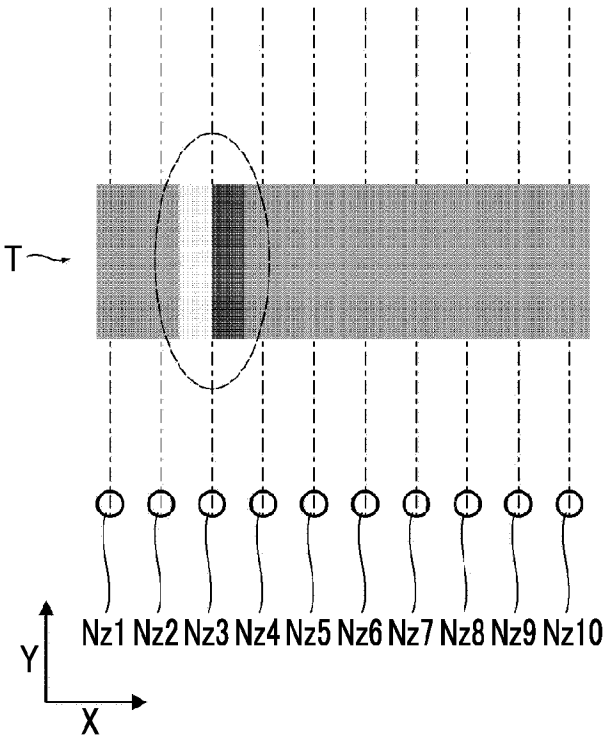
FIGS. 10A and 10B are conceptual diagrams of a nozzle inspection method using a test chart.
Figure 10A:
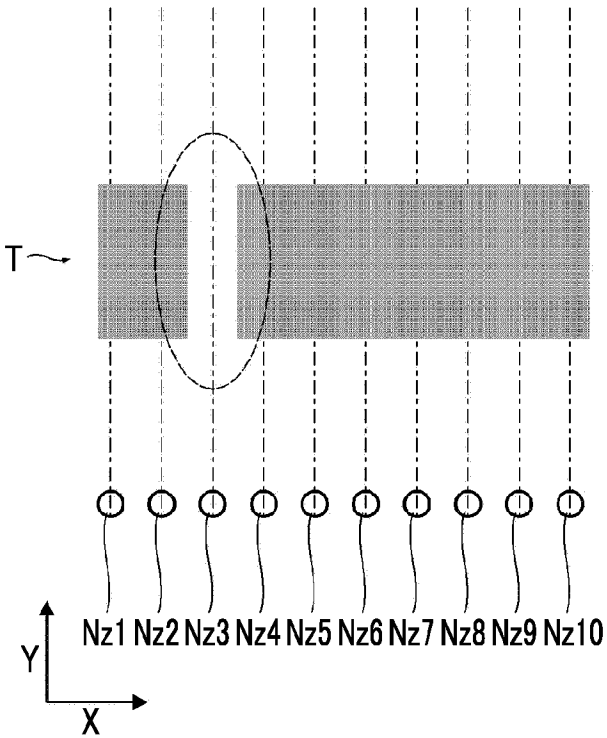

For example, when the patch shown in FIG. 8 is used, if a nozzle is placed in a non-ejection state, as shown in FIG. 10A, the patch is printed in a state where the portion of the non-ejection nozzle (in this case, a third nozzle Nz3 from the left of FIG. 10A) is missing. Accordingly, a missing portion of a printed patch is detected, whereby a non-ejection nozzle can be detected.

When the patch shown in FIG. 8 is used, if failure in the ejection direction occurs in a nozzle, as shown in FIG. 10B, density near the nozzle with failure in the ejection direction is changed (in the example shown in FIG. 10B, the ejection direction of a third nozzle Nz3 from the left is deviated from the right side (a fourth nozzle Nz4 side)). Accordingly, a portion where density of a printed patch is changed is detected, whereby a nozzle with failure in the ejection direction can be detected.

In this way, the predetermined test chart T is printed, whereby non-ejection of a nozzle or failure in the ejection direction can be detected. Abnormality in a nozzle Nz is not limited thereto, and change in volume of ink to be ejected or change in speed may be detected as abnormality.

The inspection unit 130 prints a test chart for every one printing unit (recording unit) to inspect the presence or absence of abnormality in a nozzle. Here, the term "one printing unit" refers to a unit of printing on a medium, and refers to a unit to be recognizable as single printing. In the ink jet printer 1 of this embodiment, since printing is performed on a paper sheet, printing on one sheet becomes one printing unit. In this case, a test chart is printed each time one print is printed. Therefore, the ink jet head can be inspected each time one sheet is printed.

A test chart is printed using all nozzles. Accordingly, all nozzles in the ink jet head can be inspected each time one sheet is printed.

Figure 11:
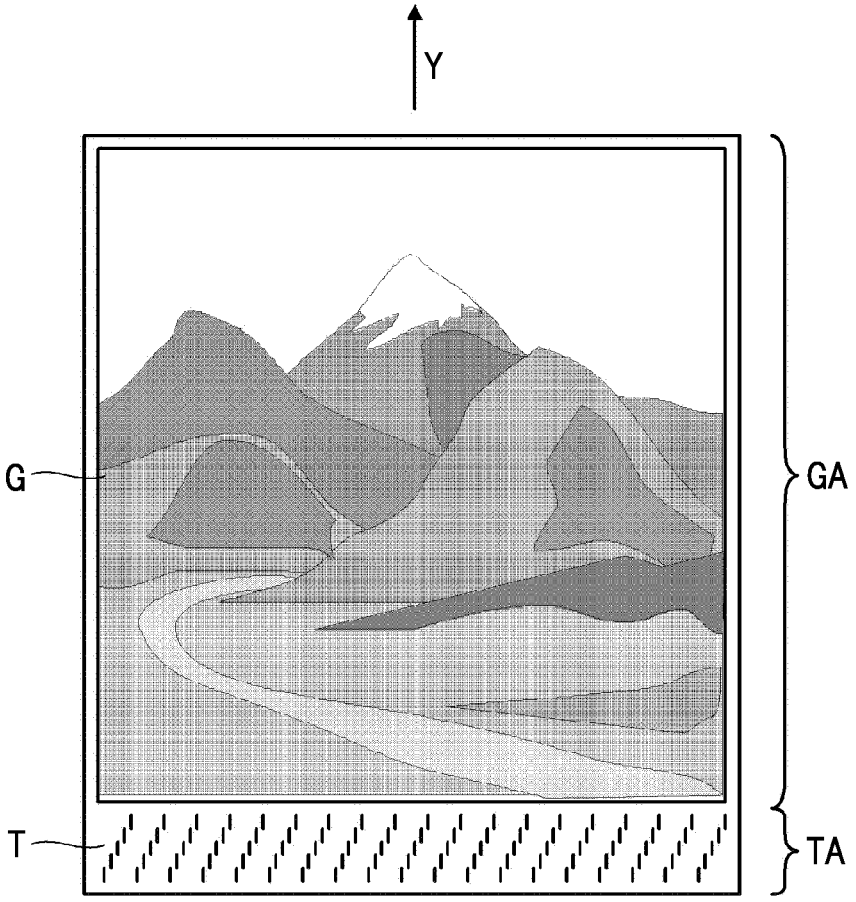
FIG. 11 is a diagram showing a printing example of a test chart.

FIG. 11 is a diagram showing a printing example of a test chart.

As shown in FIG. 11, a test chart T is recorded on one sheet P along with an image G to be printed. That is, the image G to be printed is printed with a blank space in the trailing end portion in the transport direction Y, instead of being printed on the entire surface of the sheet P, and the test chart is printed in the blank space.

If an area where the image G to be printed is printed is referred to as an image printing area GA, and an area where the test chart T is printed is referred to as a test chart printing area TA, the test chart printing area TA is formed with a given width in the trailing end portion of the sheet P in the transport direction Y. The image printing area GA is set as an area excluding the test chart printing area TA from the printing surface of the sheet P.

Although inspection can be executed for all of the ink jet heads 46C, 46M, 46Y, and 46K at one time, in this embodiment, inspection of the four ink jet heads 46C, 46M, 46Y, and 46K is executed in order. That is, the ink jet heads 46C, 46M, 46Y, and 46K are inspected in an order of cyan, magenta, yellow, and black.

Figure 12:
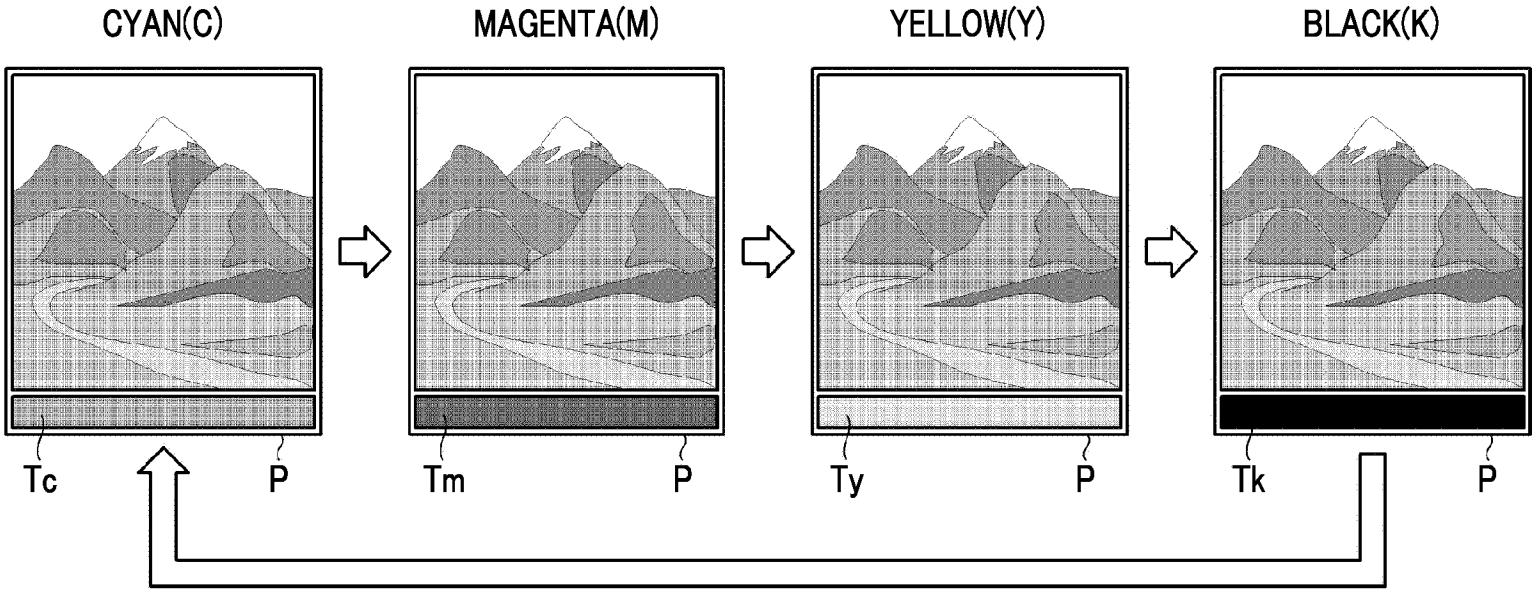
FIG. 12 is a conceptual diagram of an inspection order.

FIG. 12 is a conceptual diagram of an inspection sequence.

As shown in FIG. 12, the ink jet heads 46C, 46M, 46Y, and 46K which print the test chart T are switched in order, whereby the four ink jet heads 46C, 46M, 46Y, and 46K are inspected in order. That is, first, a test chart Tc is printed in the test chart printing area TA by the ink jet head 46C of cyan, next, a test chart Tm is printed in the test chart printing area TA by the ink jet head 46M of magenta, next, a test chart Ty is printed in the test chart printing area TA by the ink jet head 46Y of yellow, and next, a test chart Tk is printed in the test chart printing area TA by the ink jet head 46K of black. With this, an inspection object is switched in order, and the ink jet heads 46C, 46M, 46Y, and 46K are inspected at a given cycle in order.

When inspection of all ink jet heads 46C, 46M, 46Y, and 46K is executed at one time, the test charts Tc, Tm, Ty, and Tk of all ink jet heads 46C, 46M, 46Y, and 46K are printed on one sheet P.

Figure 13:
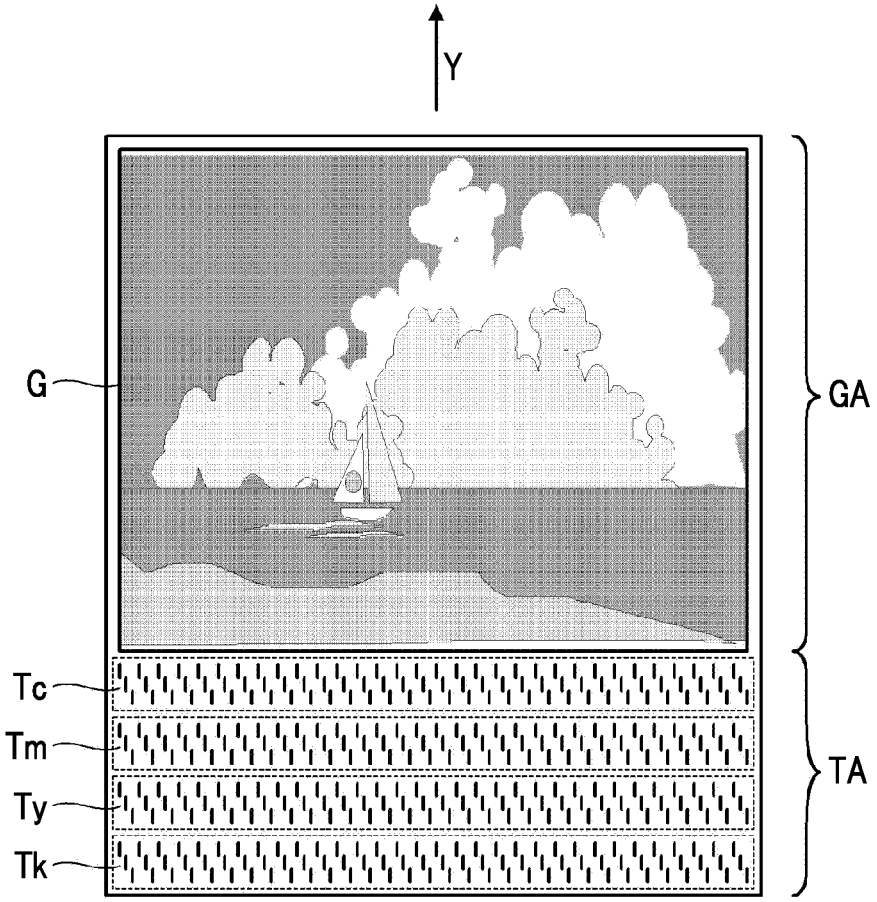
FIG. 13 is a diagram showing a printing example of a test chart.

FIG. 13 is a diagram showing a printing example of a test chart when inspection of all ink jet heads is executed at one time.

As shown in FIG. 13, when inspection of all ink jet heads 46C, 46M, 46Y, and 46K is executed at one time, the test charts Tc, Tm, Ty, and Tk of all ink jet heads 46C, 46M, 46Y, and 46K are printed in the test chart printing area TA. That is, the test charts Tc, Tm, Ty, and Tk are printed in the test chart printing area TA in order along the transport direction Y of the sheet P.

The inspection result is stored in a memory (for example, a random access memory (RAM): a random access readable and writable storage device) embedded in the computer 100. The memory functions as an inspection result storage unit 136.

In regard to the inspection result, the inspection result of normality/abnormality for all nozzles may be recorded, or only information for a nozzle in which abnormality is detected may be recorded. For example, only the number of a nozzle in which abnormality is detected may be recorded.

The determination unit 132 acquires the inspection result of the inspection unit 130 and determines the propriety of use of each nozzle in each of the ink jet heads 46C, 46M, 46Y, and 46K. At this time, the determination is performed as follows.

That is, the determination unit 132 disables a nozzle determined to have abnormality by inspection in the inspection unit 130. If the disabled nozzle is determined to have no abnormality by immediately following inspection, the determination unit 132 recovers the nozzle to be enabled. If the disabled nozzle is determined to have abnormality again within N times immediately after the nozzle is disabled, the determination unit 132 continuously disables the nozzle subsequently. In this way, the determination unit 132 determines the propriety of use of each nozzle in consideration of abnormality occurred in the past.

The determination method by the determination unit 132 will be described below in detail.

The complement unit 134 executes a required complementary process based on the determination result of the determination unit 132. That is, the use of a nozzle determined to be disabled by the determination unit 132 is prohibited, and the complementary process is executed. Here, the use prohibition means stopping of ejection from a nozzle, that is, ejection prohibition.

When printing is performed with a single pass, if there is a non-ejection nozzle, "stripe" occurs as image defect in an image to be printed. The stripe causes significant degradation of image quality. The complementary process is a process for reducing the visibility of a stripe as image defect, and is also referred to as non-ejection correction.

Figure 14:
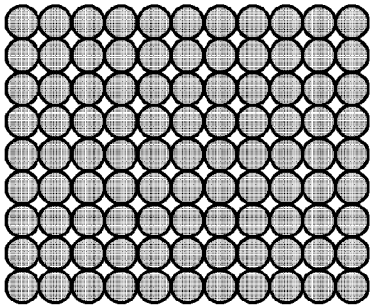
FIGS. 14 A-1 to 14 C-2 are conceptual diagrams of a complementary process.
Figure 14:
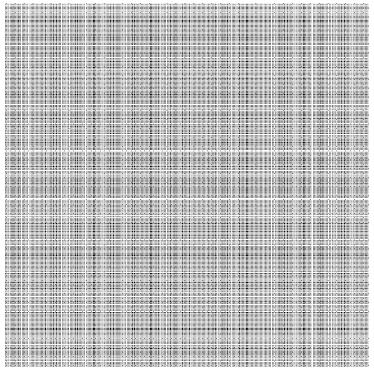
Figure 14:
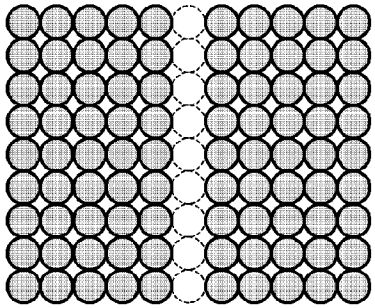
Figure 14:
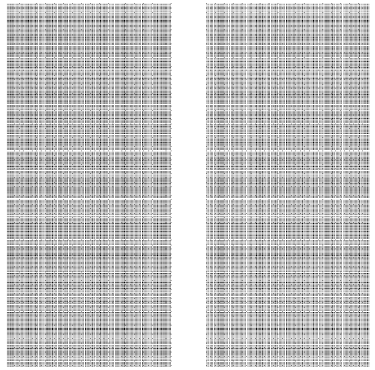
Figure 14:
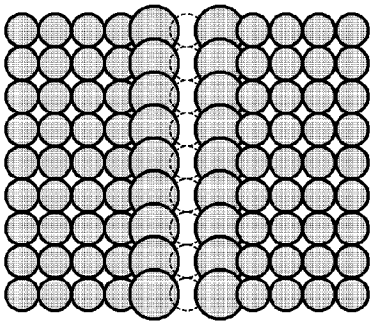
Figure 14:
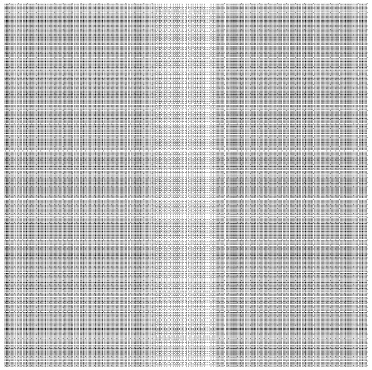

FIGS. 14 A-1 to 14 C-2 are conceptual diagrams of a complementary process.

FIG. 14 A-1 is a diagram schematically showing dot arrangement when there is no non-ejection nozzle, FIG. 14 A-2 is a diagram schematically showing the visual appearance of a printed image when there is no non-ejection nozzle, FIG. 14 B-1 is a diagram schematically showing dot arrangement when there is a non-ejection nozzle, FIG. 14 B-2 is a diagram schematically showing the visual appearance of a printed image when there is a non-ejection nozzle, FIG. 14 C-1 is a diagram schematically showing dot arrangement when a complementary process is performed, and FIG. 14 C-2 is a diagram schematically showing the visual appearance of a printed image when a complementary process is performed.

As shown in FIGS. 14 B-1 and 14 B-2, if a non-ejection nozzle occurs, a stripe (a stripe of a ground color of a medium) occurs in a drawing area corresponding to the non-ejection nozzle.

As described above, the complementary process is a process for reducing the visibility of the stripe. As shown in FIG. 14 C-1, the process is implemented by thickening drawing of a nozzle (non-ejection correction nozzle) near the non-ejection nozzle. As a method of thickening drawing of a non-ejection correction nozzle, for example, a method of scanning an output image, a method of intensifying an ejection signal to correct an ejection dot diameter strongly, or the like is known.

As shown in FIG. 14 C-2, the complementary process is performed, whereby the visibility of the stripe is reduced, and image quality is improved.

<<Printing Method>>

A process for printing by the ink jet printer 1 of this embodiment is executed as follows. That is, a printing method as an image recording method is executed as follows.

<Entire Flow of Printing>

Printing by the ink jet printer 1 is performed in an order of (a) sheet feed, (b) coating of a process liquid, (c) drying, (d) printing, (e) drying, (f) sheet discharge, and (g) accumulation. The computer executes printing according to a print job.

If printing is started, sheet feed is started from the sheet feed unit 10. The sheet P fed from the sheet feed unit 10 is first transported to the process liquid coating unit 20. Then, in a process of the sheet P being transported by the process liquid coating drum 22 of the process liquid coating unit 20, the printing surface is coated with the process liquid.

Next, the sheet P coated with the process liquid is transported to the process liquid drying unit 30. Then, in a process of the sheet P being transported by the process liquid drying drum 32 of the process liquid drying unit 30, the sheet P is dried by blowing hot air toward the printing surface.

Next, the dried sheet P is transported to the printing unit 40. Then, in a process of the sheet P being transported by the printing drum 42 of the printing unit 40, ink droplets of the respective colors are ejected from the ink jet heads 46C, 46M, 46Y, and 46K, and thus, a color image is printed on the printing surface.

Next, the sheet P with the image printed thereon is transported to the ink drying unit 50. Then, in a process of the sheet P being transported by the chain gripper 52 of the ink drying unit 50, the sheet P is heated and dried by heat emitted to the printing surface.

The heated and dried sheet P is transported to the accumulation unit 60 by the chain gripper 52 as it is, is discharged to the accumulation unit 60, and is accumulated in a bundle form.

<Inspection During Printing>

In the ink jet printer 1 of this embodiment, the test chart T is printed along with the image G to be printed (see FIG. 11). The test chart T printed on the sheet P is read by the scanner 48 in a process of being transported by the printing drum 42 of the printing unit 40. The read image data of the test chart T is applied to the inspection unit 130 and is used for inspection.

As shown in FIG. 11, the test chart T is printed on each sheet. Accordingly, inspection is performed each time one sheet is printed. That is, in the ink jet printer 1 of this embodiment, inspection of the ink jet heads 46C, 46M, 46Y, and 46K is constantly performed during printing.

The ink jet heads 46C, 46M, 46Y, and 46K are switched in order to print the test chart T. That is, as shown in FIG. 12, the ink jet heads 46C, 46M, 46Y, and 46K which print the test chart T in an order of cyan, magenta, yellow, and black are switched in order to print the test chart T. Accordingly, in the ink jet printer 1 of this embodiment, the four ink jet heads 46C, 46M, 46Y, and 46K are inspected in order.

The propriety of use of each nozzle in each of the ink jet heads 46C, 46M, 46Y, and 46K is determined based on the inspection result. As a result of the determination, if a nozzle is disabled, the use of the disabled nozzle is prohibited. That is, ejection is prohibited. Then, a complementary process of image defect due to ejection prohibition is executed. The complementary process is reflected in the sheet P to be printed next.

<<Usability Determination Method>>

First Embodiment

As described above, in the ink jet printer 1 of this embodiment, the presence or absence of abnormality in each nozzle of each of the ink jet heads 46C, 46M, 46Y, and 46K is inspected at regular intervals. Then, the propriety of use of each nozzle is determined based on the inspection result, and if it is determined to be disabled, the ejection of the corresponding nozzle is prohibited and a necessary complementary process. Here, the determination by the determination unit 132 is performed as follows.

The determination unit 132 disables a nozzle determined to have abnormality as a result of inspection by the inspection unit 130. If a nozzle is disabled, the complementary process is performed by the complement unit 134. Therefore, it is possible to cope with abnormality quickly.

If the disabled nozzle is determined to have no abnormality by immediately following inspection, the determination unit 132 recovers the nozzle to be enabled. Immediately following inspection refers to inspection which is performed next to inspection when it is determined to be disabled. In the ink jet printer 1 of this embodiment, since the four ink jet heads 46C, 46M, 46Y, and 46K are inspected in order, immediately following inspection becomes inspection after four sheets from inspection when it is determined to be disabled. If it is determined that there is no abnormality by inspection after four sheets, the determination unit 132 recovers the nozzle to be enabled. With this, it is possible to prevent erroneous determination.

If the disabled nozzle is determined to have abnormality again by inspection within N times from inspection immediately after the nozzle is disabled, the determination unit 132 continuously disables the nozzle subsequently. The number of times N is a prescribed number of times (prescribed frequency N), and is set in advance.

Since inspection within N times from immediately following inspection is performed, immediately following inspection is also included. Accordingly, if it is determined that there is abnormality again by immediately following inspection, the nozzle is continuously disabled subsequently. In this case, there is a high possibility that the nozzle is a truly abnormal nozzle; however, since the complementary process is already started, the complementary process is not delayed.

Since inspection within N times from immediately following inspection is performed, even when it is determined that there is no abnormality immediately thereafter and the nozzle is recovered to be enabled, if it is determined that there is abnormality within N times, the nozzle is continuously disabled subsequently. With this, it is possible to appropriately stop the use of an unstable nozzle.

Since inspection within N times from immediately following inspection is performed, inspection after (N+1)th inspection is not included. If it is determined that there is abnormality by inspection after (N+1)th inspection, the nozzle is disabled; however, the nozzle is not continuously disabled. In this case, if it is determined that there is no abnormality again by immediately following inspection, the nozzle is recovered to be enabled. If it is determined that there is abnormality again by inspection within N times from immediately following inspection, the nozzle is continuously disabled subsequently. That is, if it is determined to be normal over N times, the history of abnormality detected in the past is cleared. In other words, even when it is determined to be abnormal by inspection once, thereafter, if it is determined to be normal N times in succession, the nozzle is handled as a nozzle in which no abnormality occurred in the past, and is handled in the same manner as a nozzle in which no abnormality occurred in the past.

In this way, according to the determination method of this embodiment, the propriety of use of each nozzle is determined in consideration of abnormality occurred in the past. With this, it is possible to appropriately determine the propriety of use of each nozzle. Furthermore, when it is determined to be abnormal, the corresponding nozzle is readily disabled, and thereafter, is recovered as necessary. Therefore, it is possible to quickly cope with a case where image complement is truly required.

When the nozzle is continuously disabled, the period is limited to within a period set in advance. This period is set in advance as a determination period. For example, a period from maintenance to maintenance can be determined as a determination period. This is because there is a high possibility that the performance of the nozzle is restored by executing maintenance.

When the period from maintenance to maintenance is prescribed as a determination period, if the nozzle is continuously disabled, the nozzle is continuously disabled to the next maintenance. In this case, if maintenance is executed, all nozzles are recovered to be enabled.

Alternatively, the determination period can be determined based on a print job or image switching. For example, when determining the determination period based on the print job, one determination period can be set from start to end of one print job. When determining the determination period based on switching of an image to be printed, one determination period can be set until an image to be printed is switched. Since the occurrence of abnormality has sheet dependence, appropriate determination can be performed by appropriately determining the determination period based on a print job or switching of an image to be printed.

Each inspection result is stored in the memory of the computer 100 which functions as the inspection result storage unit 136. The determination unit 132 executes a determination process referring to information of the inspection result recorded in the memory. It is preferable that information of the inspection result stored in the memory is erased as necessary. For example, information is erased each time the single determination period ends.

The prescribed frequency N can be arbitrarily set (for example, N=10), and is preferably set to an optimum numerical value through an experiment or the like. Since the optimum prescribed frequency N depends on a detection success probability, the number of nozzles to be stopped, the allowable number of unstable nozzles, image defect tolerance, or the like, it is preferable that the prescribed frequency N is set to an optimum numerical value for each device or according to a user's demand level.

Second Embodiment

In this embodiment, the determination by the determination unit 132 is performed as follows.

The determination unit 132 disables a nozzle determined to have abnormality based on the inspection result of the inspection unit 130. If the nozzle is disabled, the complementary process is performed by the complement unit 134. Therefore, it is possible to cope with abnormality quickly.

If the disabled nozzle is determined to have no abnormality M times in succession from inspection immediately after the nozzle is disabled, the determination unit 132 recovers the nozzle to be enabled. With this, it is possible to prevent erroneous determination. The number of times M is a prescribed number of times (prescribed frequency M), and is set in advance.

If the disabled nozzle is determined to have abnormality again by inspection within N times from inspection immediately after the nozzle is disabled, the determination unit 132 continuously disables the nozzle subsequently. With this, it is possible to appropriately stop the use of an unstable nozzle. The number of times N is a prescribed number of times (prescribed frequency N), and is set in advance. The prescribed frequency N is set to a value greater than the prescribed frequency M.

Since inspection within N times from immediately following inspection is performed, immediately following inspection is also included. Accordingly, if it is determined that there is abnormality again by immediately following inspection, the nozzle is continuously disabled subsequently. In this case, there is a high possibility that the nozzle is a truly abnormal nozzle; however, since the complementary process is already started, the complementary process is not delayed.

Since inspection within N times from immediately following inspection is performed, even when the nozzle is recovered to be enabled, if it is determined that there is abnormality again within N times, the nozzle is continuously disabled subsequently. With this, it is possible to appropriately stop the use of an unstable nozzle.

Since inspection within N times from immediately following inspection is performed, inspection after (N+1)th inspection is not included. If it is determined that there is abnormality by inspection after (N+1)th inspection, the nozzle is disabled; however, the nozzle is not continuously disabled. In this case, if it is determined that there is no abnormality again by immediately following inspection, the nozzle is recovered to be enabled. If it is determined that there is abnormality again by inspection within N times from immediately following inspection, the nozzle is continuously disabled subsequently. That is, if it is determined to be normal over N times, the history of abnormality detected in the past is cleared. In other words, even when it is determined to be abnormal by inspection once, if it is determined to be normal N times in succession over M times, the nozzle is handled as a nozzle in which no abnormality occurred in the past, and is handled in the same manner as a nozzle in which no abnormality occurred in the past.

In this way, according to the determination method of this embodiment, the propriety of use of each nozzle is determined in consideration of abnormality occurred in the past. With this, it is possible to appropriately determine the propriety of use of each nozzle. Furthermore, when it is determined to be abnormal, the corresponding nozzle is readily disabled, and thereafter, is recovered as necessary. Therefore, it is possible to quickly cope with a case where image complement is truly required.

The period during which the nozzle is continuously disabled, that is, the determination period can be determined based on maintenance as in the first embodiment. That is, for example, one determination period can be determined to the next maintenance. Alternatively, the determination period can be determined based on a print job or switching of an image to be printed.

As in the first embodiment, each inspection result is stored in the memory (inspection result storage unit 136) embedded in the computer 100. The determination unit 132 executes a determination process referring to information of the inspection result recorded in the memory.

The prescribed frequencies N and M can be arbitrarily set (for example, M=5, N=10), and are preferably set to optimum frequencies by an experiment or the like. Since the optimum prescribed frequencies N and M depend on a detection success probability, the number of nozzles to be stopped, the allowable number of unstable nozzles, image defect tolerance, or the like, it is preferable that the prescribed frequencies N and M are set to optimum numerical values for each device or according to a user's demand level.

Third Embodiment

In the second embodiment, a nozzle determined to have abnormality as a result of inspection is disabled. Then, if the disabled nozzle is determined to have no abnormality M times in succession from immediately following inspection, the nozzle is recovered to be enabled, and if the disabled nozzle is determined to have abnormality again by inspection within N times from immediately following inspection, the nozzle is continuously disabled.

Here, the prescribed frequency N and the prescribed frequency M can be set as follows as an example. That is, the frequency K for which each nozzle is determined to be abnormal by inspection is counted, and the prescribed frequency M and the prescribed frequency N are set based on the frequency K. This process is performed by the computer 100 executing a predetermined program. That is, the computer 100 executes a predetermined program, thereby functioning as an abnormality occurrence frequency count unit 140 which counts the frequency K for which each nozzle is determined to have abnormality. Also, the computer 100 executes a predetermined control program, thereby functioning as a prescribed frequency setting unit 142 which sets the prescribed frequency M and the prescribed frequency N based on the frequency K counted by the abnormality occurrence frequency count unit 140.

Figure 15:
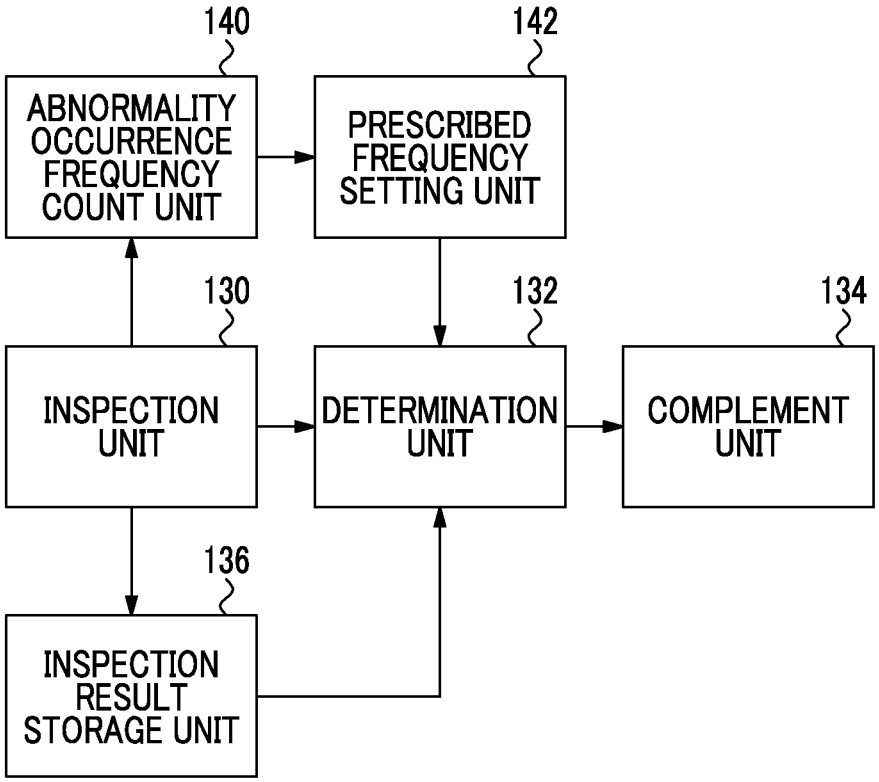
FIG. 15 is a functional block diagram of a computer which functions as an abnormality occurrence frequency count unit and a prescribed frequency setting unit.

FIG. 15 is a functional block diagram of a computer which functions as an abnormality occurrence frequency count unit and a prescribed frequency setting unit.

The abnormality occurrence frequency count unit 140 acquires the inspection result of the inspection unit 130, and counts the frequency for which each nozzle is determined to be abnormal during an inspection period set in advance.

Here, the inspection period can be arbitrarily set. As an example, one inspection period can be determined from power-on to power-off of the device. Alternatively, the inspection period can be set in terms of the number of printed sheets, time, day, week, or month.

The prescribed frequency setting unit 142 sets the prescribed frequency M and the prescribed frequency N based on the frequency K counted by the abnormality occurrence frequency count unit 140. Specifically, a number obtained by multiplying a number in set in advance by K is set as the prescribed frequency M and a number obtained by multiplying a number n set in advance by K is set as the prescribed frequency N. The number n is set to a value greater than the number m. For example, when m is 5 and n is 10, the prescribed frequency M is set to 5K, and the prescribed frequency N is set to 10K ($M<N$ ($5K<10K$)).

In this way, the prescribed frequency M and the prescribed frequency N are set, whereby it is possible to set the prescribed frequency M and the prescribed frequency N using the history in the past and to more appropriately determine the propriety of use of each nozzle.

Fourth Embodiment

In the third embodiment, when setting the prescribed frequency M and the prescribed frequency N, the number obtained by multiplying the number m set in advance by K is set as the prescribed frequency M and the number obtained by multiplying the number n set in advance by K is set as the prescribed frequency N.

In this embodiment, the prescribed frequency N and the prescribed frequency M are set as follows. That is, a frequency K for which a nozzle is determined to have abnormality during an inspection period set in advance is counted, and a number obtained by multiplying a number m set in advance by K-th power is set as the prescribed frequency M. Also, a number obtained by multiplying a number n set in advance by K-th power is set as the prescribed frequency N. The number n is set to a value greater than the number m. For example, when m is 5 and n is 10, the prescribed frequency M is set to 5^K (a symbol "^" is an operation symbol of power), and the prescribed frequency N is set to 10K (M<N (5K<10K)).

In this way, the prescribed frequency M and the prescribed frequency N are set, whereby, as in the third embodiment, it is possible to set the prescribed frequency M and the prescribed frequency N using the history in the past and to more appropriately determine the propriety of use of each nozzle.

Other Embodiments

<Notification of Abnormality>

The determination method of each embodiment is combined with a predetermined notification function, thereby further improving usefulness. For example, when a disabled nozzle is recovered to be enabled and when a nozzle is continuously disabled, the fact is notified to the operator. With this, the operator can recognize that the complementary process is performed, and can efficiently check a printed matter.

For example, when a nozzle is recovered to be enabled and is then continuously disabled, the nozzle can be considered as an unstable nozzle. Accordingly, when the disabled nozzle is recovered to be enabled and when the nozzle is continuously disabled, the fact is notified to the operator, whereby it is possible to make the operator recognize that there is an unstable nozzle.

For example, when the nozzle is not recovered to be enabled and is continuously disabled, the nozzle can be considered as a truly abnormal nozzle. Accordingly, only the fact that the nozzle is continuously disabled is notified to the operator, whereby it is possible to make the operator recognize that there is a truly abnormal nozzle.

For example, when a nozzle is recovered to be enabled and then continues to be operated normally, the detection of abnormality in the nozzle can be considered as erroneous detection. Accordingly, only the fact that the nozzle is recovered to be enabled is notified to the operator, whereby it is possible to make the operator recognize that erroneous detection occurs.

The notification can be performed, for example, using the display unit 106 connected to the computer 100. That is, when the disabled nozzle is recovered to be enabled and when the nozzle is continuously disabled, the fact is displayed on the display screen of the display unit 106 and is notified to the operator. In this case, the computer 100 and the display unit 106 function as a notification unit in cooperation.

The notification may be performed using the stamp device 58. In this case, for example, for an unstable nozzle, a stamp is put on a sheet when the nozzle is recovered to be enabled and the sheet P when the nozzle is continuously disabled. For a truly abnormal nozzle, a stamp is put only on the sheet P when the nozzle is continuously disabled. When erroneous detection is suspected, a stamp is put only on the sheet P when the nozzle is recovered to be enabled. With this, it is possible to understand the occurrence situation of abnormality in a nozzle or the like from the situation in which a stamp is put. In this case, the stamp device 58 functions as a notification unit.

<When Printing is Performed on Continuous Paper>

In the foregoing embodiment, although a case where printing is performed on a paper sheet has been described as an example, the application of the invention is not limited thereto. The invention can be similarly applied to a case where printing is performed on continuous paper.

Figure 16:
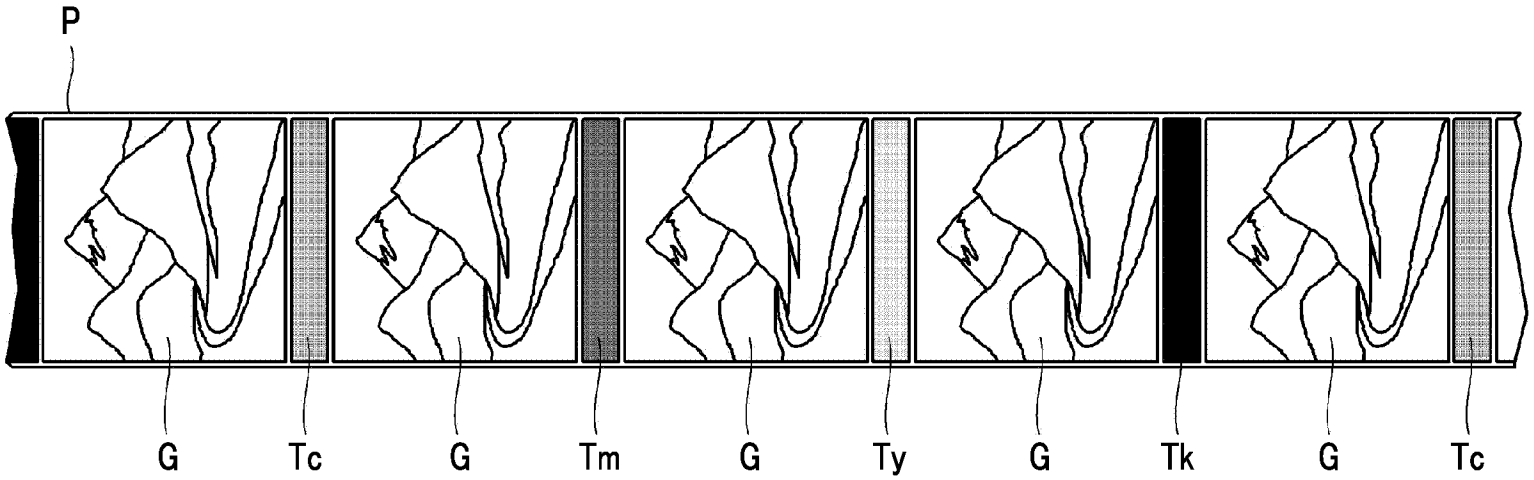
FIG. 16 is a diagram showing a printing example of a test chart when printing on continuous paper.

FIG. 16 is a diagram showing a printing example of a test chart when printing is performed on continuous paper.

When printing is performed on continuous paper, a unit of an image G periodically recorded becomes one printing unit. In this case, a test chart is recorded between the images G periodically recorded. In the example shown in FIG. 16, a case where the four ink jet heads of cyan, magenta, yellow, and black are inspected in order will be described as an example. In this case, test charts Tc, Tm, Ty, and Tk are printed in an order of cyan, magenta, yellow, and black. When inspection of all ink jet heads is performed at one time, the test charts of all ink jet heads are printed between the images G.

<Execution Timing of Inspection>

In the foregoing embodiment, although a test chart is printed along with an image to be printed, and inspection is executed each time each sheet is printed, the timing of executing inspection is not limited thereto. Inspection may be executed at an interval of several sheets. For example, inspection may be executed for every other sheet.

A test chart may be printed separately from an image to be printed. That is, a test chart may be printed on a sheet different from an image to be printed.

<Reading of Image>

In the ink jet printer 1 of the foregoing embodiment, although the scanner 48 is provided on the transport path of the sheet P by the printing drum 42 to read a printed image, the place where the scanner as image reading means is provided is not limited to this position. For example, the scanner may be provided on the transport path of the sheet P by the chain gripper 52 to read an image after heating and drying.

An image immediately after printing is read, whereby it is possible to make the determination result by the determination unit 132 reflected rapidly. A scanner is provided on the transport path of the same transport means as an ink jet head as a print head, whereby it is possible to improve reading accuracy, and consequently, to improve inspection accuracy.

<Other Examples of Image Recording Apparatus>

The invention effectively functions as an inspection method of a print head having recording elements arranged linearly or in a matrix. Accordingly, the invention effectively functions as an inspection method and an inspection device even in a print head other than an ink jet system as long as the print head has recording elements arranged linearly or in a matrix. For example, the invention also effectively functions as an inspection method and an inspection device of a thermal print head which has heat generation elements as recording elements arranged linearly or in a matrix.

The invention is not limited to a line head, and can be similarly applied to a case where a serial head is inspected.

The recording elements are not limited to linear arrangement, and may be arranged in a matrix.

EXAMPLES

In order to confirm the effects of the invention, comparative verification with the prior art by a simulation was performed.

FIGS. 17A to 23C are tables showing the result of comparative verification by a simulation. In FIGS. 17A to 23C, an item "page" represents the number of processed sheets from the start of printing. An item "inspection" represents an inspection result, and "OK" indicates an inspection result to be normal and "NG" indicates an inspection result to be abnormal. An item "determination" represents a determination result, and "E" indicates an inspection result to be enabled and "D" indicates an inspection result to be disabled. An item "complement" represents an execution result of a complementary process, and "ON" indicates that the complementary process is executed and "OFF" indicates that the complementary process is not executed. An item "image defect" represents the result of the presence or absence of image defect (in this case, stripe), and "NG" indicates that there is image defect and "OK" indicates that there is no image defect (equal to or less than an allowable level).

The complementary process is executed from printing immediately after a nozzle is disabled as a result of the determination. In order to facilitate comparison, a result focusing only on a specific nozzle is shown.

Comparative Example 1

FIGS. 17A to 17B are tables showing an execution situation of a complementary process and an occurrence situation of image defect when the propriety of use of each nozzle is determined by the determination method described in JP2014-91300A and JP2013-129112A. FIG. 17A shows an execution situation of a complementary process and an occurrence situation of image defect when a truly abnormal nozzle is present. FIG. 17B shows an execution situation of a complementary process and an occurrence situation of image defect when an unstable nozzle is present. FIG. 17C shows an execution situation of a complementary process and an occurrence situation of image defect when erroneous detection is suspected.

In the determination method of JP2014-91300A and JP2013-129112A, if it is determined to be abnormal once by inspection, the nozzle is continuously disabled subsequently.

As shown in FIG. 17A, if it is determined to be abnormal by inspection, the complementary process is already performed. Accordingly, it is advantageous in that reaction to a truly abnormal nozzle is rapid.

As shown in FIG. 17B, if it is determined to be abnormal once, the nozzle is continuously disabled subsequently. Accordingly, it is advantageous in that this method is resistant to an unstable nozzle.

As shown in FIG. 17C, even in the case of erroneous detection, the nozzle is disabled subsequently. Accordingly, it is disadvantageous in that this method is susceptible to erroneous detection.

In the determination method of JP2014-91300A and JP2013-129112A, if a probability that a normal nozzle is determined to be abnormal is 0.3% (3σ), a probability that it is determined to be abnormal over at least once when 100 sheets are printed and inspection is performed for each sheet becomes about 30%. If it is assumed that the total number of nozzles is 10000, nozzles over 3000 are disabled and will be complemented. Then, correction capability is exceeded, and image defect (stripe) occurs.

Comparative Example 2

FIGS. 18A to 18C are tables showing an execution situation of a complementary process and an occurrence situation of image defect when the propriety of use of each nozzle is determined by the determination method described in JP2004-209460A. FIG. 18A shows an execution situation of a complementary process and an occurrence situation of image defect when a truly abnormal nozzle is present. FIG. 18B shows an execution situation of a complementary process and an occurrence situation of image defect when an unstable nozzle is present. FIG. 18C shows an execution situation of a complementary process and an occurrence situation of image defect when erroneous detection is suspected.

In the determination method of JP2004-209460A, if it is determined to be abnormal twice in succession, the nozzle is disabled.

If it is determined to be abnormal twice in succession, the nozzle is disabled. Accordingly, as shown in FIG. 18C, it is advantageous in that this method is resistant to erroneous detection.

On the other hand, if it is not determined to be abnormal twice in succession, the nozzle is not disabled. Accordingly, as shown in FIG. 18A, it is disadvantageous in that reaction to a truly abnormal nozzle is slow.

As shown in FIG. 18B, it is disadvantageous that an unstable nozzle is not easily captured.

That is, in the case of detection twice in succession, while this is resistant to erroneous detection (noise), it is disadvantageous in that the number of loss sheets until the complementary process is executed is increased. If an unstable nozzle cannot be detected twice in success, it is disadvantageous in that the unstable nozzle cannot be captured.

Comparative Example 3

FIGS. 19A to 19C are tables showing an execution situation of a complementary process and an occurrence situation of image defect when the propriety of use of each nozzle is determined by the determination method described in JP1996-187881A (JP-H08-187881A). FIG. 19A shows an execution situation of a complementary process and an occurrence situation of image defect when a truly abnormal nozzle is present. FIG. 19B shows an execution situation of a complementary process and an occurrence situation of image defect when an unstable nozzle is present. FIG. 19C shows an execution situation of a complementary process and an occurrence situation of image defect when erroneous detection is suspected.

In the determination method of JP1996-187881A (JP-H08-187881A), if it is determined to be abnormal by inspection, the nozzle is disabled; however, if it is determined to be normal by subsequent inspection, the nozzle is recovered to be enabled.

If it is determined to be abnormal, the nozzle is disabled. Accordingly, as shown in FIG. 19A, it is advantageous in that reaction to a truly abnormal nozzle is rapid.

Even when it is determined to be abnormal, if it is determined to be normal by subsequent inspection, the nozzle is recovered to be enabled. Accordingly, as shown in FIG. 19C, it is advantageous in that this method is resistant to erroneous detection.

In regard to an unstable nozzle, as shown in FIG. 19B, since the unstable nozzle is opened, it is disadvantageous in that this method is susceptible to an unstable nozzle.

That is, the determination method of JP2004-209460A is susceptible to an unstable nozzle, and an unstable state is continued until maintenance is entered. Accordingly, it is disadvantageous in that operation by this method is difficult.

Example 1

FIGS. 20A to 20C are tables showing an execution situation of a complementary process and an occurrence situation of image defect when the propriety of use of each nozzle is determined by the determination method of the first embodiment. FIG. 20A shows an execution situation of a complementary process and an occurrence situation of image defect when a truly abnormal nozzle is present. FIG. 20B shows an execution situation of a complementary process and an occurrence situation of image defect when an unstable nozzle is present. FIG. 20C shows an execution situation of a complementary process and an occurrence situation of image defect when erroneous detection is suspected.

In this example, the prescribed frequency N is set to 10. In this case, if it is determined that there is abnormality by inspection, the nozzle is disabled. Then, if the disabled nozzle is determined to have no abnormality by immediately following inspection, the nozzle is recovered to be enabled. If the disabled nozzle is determined to have abnormality again by inspection within ten times from immediately following inspection, the nozzle is continuously disabled.

<In Regard to Truly Abnormal Nozzle>

As shown in FIG. 20A, in this example, if it is determined that there is abnormality by inspection, the nozzle is readily disabled and the complementary process is performed. For this reason, it is possible to cope with abnormal nozzle rapidly.

In the case of a truly abnormal nozzle, it is determined to be abnormal in succession according to inspection. As shown in FIG. 20A, since the truly abnormal nozzle is disabled by initial abnormality detection (in the example shown in FIG. 20A, a third page), it is possible to cope with a truly abnormal nozzle rapidly.

<In Regard to Unstable Nozzle>

As shown in FIG. 20B, in this example, if the disabled nozzle is determined to have abnormality again by inspection within ten times from immediately following inspection, the nozzle is continuously disabled. For this reason, even when there is an unstable nozzle, it is possible to stop the use of the unstable nozzle.

In the example of FIG. 20B, while the nozzle is determined to be abnormal (NG) by inspection on the third page and is disabled (D), and the nozzle is determined to be normal (OK) by inspection on a fourth page and is recovered to be enabled (E), since the nozzle is determined to be abnormal (NG) again by subsequent inspection of a fifth page, the nozzle is continuously disabled (D). For this reason, even when the nozzle is determined to be normal (OK) by inspection on a sixth page, an eighth page, and a tenth page, the nozzle is continuously disabled (D).

In this way, when it is determined to be abnormal again during a given period, the nozzle is continuously disabled, whereby it is possible to stop the use of an unstable nozzle and to achieve stable operation.

A condition for continuously disabling a nozzle is that it is determined to be abnormal by inspection within ten times. Accordingly, even when it is determined to be abnormal by inspection over ten times, the nozzle is not continuously disabled. In this case, the propriety of continuous use is determined again based on abnormality detected over ten times.

<When Erroneous Detection is Suspected>

As shown in FIG. 20C, in this example, if it is determined that there is no abnormality by immediately following inspection, the nozzle is recovered to be enabled. Even when it is determined that there is abnormality by inspection, if it is determined that there is no abnormality by immediately following inspection, there is a possibility of erroneous detection. In this case, the nozzle is recovered to be enabled, whereby it is possible to stop the complementary process and to prevent an unnecessary complementary process from being performed.

In this way, according to this example, it is possible to desirably cope with a truly abnormal nozzle, an unstable nozzle, and even when erroneous detection is suspected.

In this example, when a notification using a stamp is executed, and when a truly abnormal nozzle occurs, a stamp is put on the third sheet. When an unstable nozzle occurs, a stamp is put on the third page and the fifth page. When erroneous detection is suspected, a stamp is put on the fifth page.

Example 2

FIGS. 21A to 21C are tables showing an execution situation of a complementary process and an occurrence situation of image defect when the propriety of use of each nozzle is determined by the determination method of the second embodiment. FIG. 21 A shows an execution situation of a complementary process and an occurrence situation of image defect when a truly abnormal nozzle is present. FIG. 21B shows an execution situation of a complementary process and an occurrence situation of image defect when an unstable nozzle is present. FIG. 21C shows an execution situation of a complementary process and an occurrence situation of image defect when erroneous detection is suspected.

In this example, the prescribed frequency M is set to 5, and the prescribed frequency N is set to 10. In this case, it is determined that there is abnormality by inspection, the nozzle is disabled. Then, if the disabled nozzle is determined to have no abnormality five times in succession from inspection immediately after the nozzle is disabled, the nozzle is recovered to be enabled. If the disabled nozzle is determined to have abnormality again by inspection within ten times from inspection immediately after the nozzle is disabled, the nozzle is continuously disabled.

<In Regard to Truly Abnormal Nozzle>

As shown in FIG. 21A, in this example, if it is determined that there is abnormality by inspection, the nozzle is readily disabled and the complementary process is performed. Accordingly, it is possible to cope with a truly abnormal nozzle rapidly.

In the case of a truly abnormal nozzle, it is determined to be abnormal in inspection in succession. As shown in FIG. 21A, since the nozzle is disabled by initial abnormality detection (in the example of FIG. 21A, a third page), it is possible to cope with a truly abnormal nozzle rapidly.

<In Regard to Unstable Nozzle>

As shown in FIG. 21B, in this example, if the disabled nozzle is determined to have abnormality again by inspection within ten times from immediately following inspection, the nozzle is continuously disabled. Therefore, even when there is an unstable nozzle, it is possible to stop the use of the unstable nozzle. With this, it is possible to achieve stable operation.

In the example shown in FIG. 21B, while the nozzle is determined to be abnormal (NG) by inspection on a third page and is disabled (D), and is then determined to have no abnormality (OK) by inspection on a fourth page, since the nozzle is determined to have abnormality (NG) again by subsequent inspection on a fifth page, the nozzle is continuously disabled (D).

A condition for recovering a nozzle to be enabled is that it is determined that there is no abnormality five times in succession from inspection immediately after the nozzle is disabled. Accordingly, in this example, even when it is determined that there is no abnormality (OK) by inspection on the fourth page, the nozzle is not recovered to be enabled at the time of the fourth page.

In this example, a condition for continuously disabling a nozzle is that it is determined to be abnormal by inspection within ten times. Accordingly, even when it is determined to be abnormal by inspection over ten times, the nozzle is not continuously disabled. In this case, the propriety of continuous use is determined again based on abnormality detected over ten times.

<When Erroneous Detection is Suspected>

As shown in FIG. 21C, in this example, if it is determined that there is no abnormality five times in succession from inspection immediately after it is determined that there is abnormality, the nozzle is recovered to be enabled. Even when it is determined that there is abnormality by inspection, thereafter, if it s determined that there is no abnormality in succession, there is a possibility of erroneous detection. In this case, the nozzle is recovered to be enabled, whereby it is possible to stop the complementary process and to stop an unnecessary complementary process from being performed.

In the example shown in FIG. 21C, while the nozzle is determined to be abnormal (NG) by inspection on the third page and is disabled (D), thereafter, since the nozzle is determined to have no abnormality five times in succession, the nozzle is recovered to be enabled (E) after inspection on an eighth page.

In this way, according to this example, it is possible to desirably cope with a truly abnormal nozzle, an unstable nozzle, and even when erroneous detection is suspected.

In this example, a condition for recovering a nozzle to be enabled becomes strict compared to Example 1. Therefore, it is possible to achieve stronger determination for an unstable nozzle.

Example 3

FIGS. 22A to 22C are tables showing an execution situation of a complementary process and an occurrence situation of image defect when the propriety of use of each nozzle is determined by the determination method of the third embodiment. FIG. 22A shows an execution situation of a complementary process and an occurrence situation of image defect when a truly abnormal nozzle is present. FIG. 22B shows an execution situation of a complementary process and an occurrence situation of image defect when an unstable nozzle is present. FIG. 22C shows an execution situation of a complementary process and an occurrence situation of image defect when erroneous detection is suspected.

In this example, the number m is set to 5, and the number n is set 10. It is assumed that abnormality is detected twice during the inspection period (K=2).

In this case, if it is determined that there is abnormality by inspection, the nozzle is disabled. Then, if the disabled nozzle is determined to have no abnormality ten (prescribed frequency M=m×K=5×2) times in succession from inspection immediately after the nozzle is disabled, the nozzle is recovered to be enabled. If the disabled nozzle is determined to have abnormality again by inspection within 20 (the prescribed frequency N=n×K=10×2) from inspection immediately after the nozzle is disabled, the nozzle is continuously disabled.

FIGS. 22A to 22C show a situation from a 30th page. As described above, the prescribed frequency M is set to m×K=5×2=10 times at the time of the 30th page, and the prescribed frequency N is set to n×K=10×2=20 times.

<In Regard to Truly Abnormal Nozzle>

As shown in FIG. 22A, in this example, if it is determined that there is abnormality by inspection, the nozzle is readily disabled and the complementary process is performed. Accordingly, it is possible to cope with a truly abnormal nozzle rapidly.

<In Regard to Unstable Nozzle>

As shown in FIG. 22B, in this example, if the disabled nozzle is determined to have abnormality again by inspection within 20 (=n×K=10×2) times from immediately following inspection, the nozzle is continuously disabled. Therefore, even when there is an unstable nozzle, it is possible to stop the use of the unstable nozzle. With this, it is possible to achieve stable operation.

In the example shown in FIG. 22B, while the nozzle is determined to be abnormal (NG) by inspection on a 32nd page and is disabled (D), and is then determined to have no abnormality (OK) by inspection on a 33rd page, since the nozzle is determined to have abnormality (NG) again by inspection on a 34th page, the nozzle is continuously disabled (D).

A condition for recovering a nozzle to be enabled is that it is determined that there is no abnormality ten times in succession from inspection immediately after the nozzle is disabled. Accordingly, in this example, even when it is determined to have no abnormality (OK) by inspection on the 33rd page, the nozzle is not recovered to be enabled at the time of the 33rd page.

In this example, a condition for continuously disabling a nozzle is that it is determined to be abnormal by inspection within 20 times. Accordingly, even when it is determined to be abnormal by inspection over 20 times, the nozzle is not continuously disabled. In this case, the propriety of continuous use is determined again based on abnormality detected over 20 times.

<When Erroneous Detection is Suspected>

As shown in FIG. 22C, in this example, if it is determined that there is no abnormality 10 (=m×K=5×2) times in succession from inspection immediately after it is determined that there is abnormality, the nozzle is recovered to be enabled. Even when it is determined that there is abnormality by inspection, thereafter, if it is determined that there is no abnormality in succession, there is a possibility of erroneous detection. In this case, the nozzle is recovered to be enabled, whereby it is possible to stop the complementary process and to prevent an unnecessary complementary process from being performed.

In the example shown in FIG. 22C, while the nozzle is determined to be abnormal (NG) by inspection on a 32nd page and is disabled (D), thereafter, since it is determined that there is no abnormality (OK) ten times in succession, the nozzle is recovered to be enabled (E) after inspection on a 42nd page.

In this way, according to this example, it is possible to desirably cope with a truly abnormal nozzle, an unstable nozzle, and even when erroneous detection is suspected.

In this example, a condition for recovering a nozzle to be enabled become strict compared to Examples 1 and 2. Therefore, it is possible to achieve stronger determination for an unstable nozzle. Furthermore, the prescribed frequency M and the prescribed frequency N are set in consideration of the history in the past. Therefore, it is possible to achieve more appropriate determination.

Example 4

FIGS. 23A to 23C are tables showing an execution situation of a complementary process and an occurrence situation of image defect when the propriety of use of each nozzle is determined by the determination method of the fourth embodiment. FIG. 23A shows an execution situation of a complementary process and an occurrence situation of image defect when a truly abnormal nozzle is present. FIG. 23B shows an execution situation of a complementary process and an occurrence situation of image defect when an unstable nozzle is present. FIG. 23C shows an execution situation of a complementary process and an occurrence situation of image defect when erroneous detection is suspected.

In this example, the number m is set to 5, and the number n is set 10. It is assumed that abnormality is detected twice during the inspection period (K=2).

In this case, if it is determined that there is abnormality by inspection, the nozzle is disabled. Then, if the disabled nozzle is determined to have no abnormality 25 (the prescribed frequency M=m^K=5^2) times in succession from inspection immediately after the nozzle is disabled, the nozzle is recovered to be enabled. If the disabled nozzle is determined to have abnormality again by inspection within 100 (the prescribed frequency N=n^K=10^2) from inspection immediately after the nozzle is disabled, the nozzle is continuously disabled.

FIGS. 23A to 23C show a situation from a 30th page. As described above, the prescribed frequency M is set to m^K=5^2=25 times at the time of the 30th page, and the prescribed frequency N is set to n^K=10^2=100 times.

<In Regard to Truly Abnormal Nozzle>

As shown in FIG. 23A, in this example, if it is determined that there is abnormality by inspection, the nozzle is readily disabled and the complementary process is performed. Accordingly, it is possible to cope with a truly abnormal nozzle rapidly.

<In Regard to Unstable Nozzle>

As shown in FIG. 23B, in this example, if the disabled nozzle is determined to have abnormality again within 100 (=n^K=100) times from immediately following inspection, the nozzle is continuously disabled. Therefore, even when there is an unstable nozzle, it is possible to stop the use of the unstable nozzle. With this, it is possible to achieve stable operation.

In the example shown in FIG. 23B, while the nozzle is determined to be abnormal (NG) by inspection on a 32nd page and is disabled (D), and is then determined to have no abnormality (OK) by inspection on a 33rd page, thereafter, since the nozzle is determined to have abnormality (NG) again by inspection on a 34th page, the nozzle is continuously disabled (D).

A condition for recovering a nozzle to be enabled is that it is determined that there is no abnormality 25 times in succession from inspection immediately after the nozzle is disabled. Accordingly, in this example, even when it is determined that there is no abnormality (OK) by inspection on the 33rd page, the nozzle is not recovered to be enabled at the time of the 33rd page.

In this example, a condition for continuously disabling a nozzle is that it is determined to be abnormal by inspection within 100 times. Accordingly, even when it is determined to be abnormal by inspection over 100 times, the nozzle is not continuously disabled. In this case, the propriety of continuous use is determined again based on abnormality detected over 100 times.

<When Erroneous Detection is Suspected>

As shown in FIG. 23C, in this example, if it is determined that there is no abnormality 25 (=m^K=5^2) times in succession from inspection immediately after it is determined that there is abnormality, the nozzle is recovered to be enabled. Even when it is determined that there is abnormality by inspection, thereafter, if it is determined that there is no abnormality in succession, there is a possibility of erroneous detection. In this case, the nozzle is recovered to be enabled, whereby it is possible to stop the complementary process and to prevent an unnecessary complementary process from being performed.

In the example shown in FIG. 23C, while the nozzle is determined to be abnormal (NG) by inspection on a 32nd page and is disabled (D), thereafter, since it is determined that there is no abnormality (OK) 25 times in succession, the nozzle is recovered to be enabled after inspection on a 57th page.

In this way, according to this example, it is possible to desirably cope with a truly abnormal nozzle, an unstable nozzle, and even when erroneous detection is suspected.

In this example, a condition for recovering a nozzle to be enabled become strict compared to Examples 1 and 2. Therefore, it is possible to achieve stronger determination for an unstable nozzle. Furthermore, the prescribed frequency M and the prescribed frequency N are set in consideration of the history in the past. Therefore, it is possible to achieve more appropriate determination.

As described above, according to the invention, it is possible to desirably cope with a truly abnormal nozzle, an unstable nozzle, and even when erroneous detection is suspected.

What is claimed is:

1. An image recording apparatus comprising:

an inspection unit which inspects the presence or absence of abnormality in each recording element of a print head at regular intervals;

a determination unit which determines the propriety of use of each recording element based on the inspection result of the inspection unit;

a complement unit which prohibits the use of the recording element determined to be disabled by the determination unit and complements image defect due to the use-prohibited recording element, wherein the determination unit disables a recording element determined to have abnormality by inspection in the inspection unit during a determination period set in advance, if the disabled recording element is determined to have no abnormality for a prescribed frequency M in succession from inspection immediately after the recording element is disabled, recovers the recording element to be enabled, and if the disabled recording element is determined to have abnormality again by inspection within a prescribed frequency N from inspection immediately after the recording element is disabled, continuously disables the recording element during the determination period, an abnormality occurrence frequency count unit which counts a frequency K for which the recording element is determined to have abnormality by inspection in the inspection unit during an inspection period set in advance; and a prescribed frequency setting unit which sets the prescribed frequency M and the prescribed frequency N based on the frequency K counted by the abnormality occurrence frequency count unit, wherein the prescribed frequency setting unit sets a number obtained by multiplying a number m set in advance by K as the prescribed frequency M and sets a number obtained by multiplying a number n set in advance by K as the prescribed frequency N.

2. The image recording apparatus according to claim 1, further comprising:

a notification unit which, in cases where the recording element is recovered from disabled to enabled, gives a notification indicating that the recording element is recovered from disabled to enabled, and in cases where the recording element is continuously disabled, gives a notification indicating that the recording element is continuously disabled.

3. The image recording apparatus according to claim 1, wherein the print head records an image on a medium by a single pass.

4. The image recording apparatus according to claim 1, wherein the inspection unit inspects the presence or absence of abnormality in each recording element based on a test chart recorded on a medium.

5. The image recording apparatus according to claim 4, wherein the test chart is recorded for every one recording element.

6. The image recording apparatus according to claim 1, wherein the print head is an ink jet head and includes nozzles as the recording elements, and the inspection unit inspects the presence or absence of ejection abnormality in each nozzle.

7. The image recording apparatus according to claim 6, wherein the complement unit prohibits the ejection of a nozzle determined to be disabled by the determination unit and complements image defect due to the ejection-prohibited nozzle.

8. An image recording method of the image recording apparatus which comprises:

an inspection unit which inspects the presence or absence of abnormality in each recording element of a print head at regular intervals;

a determination unit which determines the propriety of use of each recording element based on the inspection result of the inspection unit; and a complement unit which prohibits the use of the recording element determined to be disabled by the determination unit and complements image defect due to the use-prohibited recording element, wherein the determination unit disables a recording element determined to have abnormality by inspection in the inspection unit during a determination period set in advance, if the disabled recording element is determined to have no abnormality for a prescribed frequency M in succession from inspection immediately after the recording element is disabled, recovers the recording element to be enabled, and if the disabled recording element is determined to have abnormality again by inspection within a prescribed frequency N from inspection immediately after the recording element is disabled, continuously disables the recording element during the determination period, the image recording method comprising:

disabling the recording element determined to have abnormality by inspection in the inspection unit during a determination period set in advance, if the disabled recording element is determined to have no abnormality for a prescribed frequency M in succession from inspection immediately after the recording element is disabled, recovering the recording element to be enabled, and if the disabled recording element is determined to have abnormality again by inspection within a prescribed frequency N from inspection immediately after the recording element is disabled, continuously disabling the recording element during the determination period; and in cases where the recording element is disabled, prohibiting the use of the disabled recording element, complementing image defect due to the use-prohibited recording element, and recording an image, and counting a frequency K for which the recording element is determined to have abnormality by inspection in the inspection unit during an inspection period set in advance, and setting a number obtained by multiplying a number m set in advance by K as the prescribed frequency M and setting a number obtained by multiplying a number n set in advance by K as the prescribed frequency N.

9. The image recording method according to claim 8, further comprising:

in cases where the recording element is recovered from disabled to enabled, giving a notification indicating that the recording element is recovered from disabled to enabled, and in cases where the recording element is continuously disabled, giving a notification indicating that the recording element is continuously disabled.

10. The image recording method according to claim 9, wherein a notification is given by putting a stamp on a medium.

11. The image recording method according to claim 8, wherein the print head records an image on a medium by a single pass.

12. The image recording method according to claim 8, wherein the presence or absence of abnormality in each recording element is inspected based on a test chart recorded on a medium.

13. The image recording method according to claim 12, wherein the test chart is recorded for every one recording element.

14. The image recording method according to claim 8, wherein the print head is an ink jet head and includes nozzles as the recording elements, and the presence or absence of ejection abnormality in each nozzle is inspected.

15. The image recording method according to claim 14, wherein the ejection of a nozzle determined to be disabled by the determination unit is prohibited and image defect due to the ejection-prohibited nozzle is complemented.

16. An image recording apparatus comprising:

an inspection unit which inspects the presence or absence of abnormality in each recording element of a print head at regular intervals;

a determination unit which determines the propriety of use of each recording element based on the inspection result of the inspection unit;

a complement unit which prohibits the use of the recording element determined to be disabled by the determination unit and complements image defect due to the use-prohibited recording element, wherein the determination unit disables a recording element determined to have abnormality by inspection in the inspection unit during a determination period set in advance, if the disabled recording element is determined to have no abnormality for a prescribed frequency M in succession from inspection immediately after the recording element is disabled, recovers the recording element to be enabled, and if the disabled recording element is determined to have abnormality again by inspection within a prescribed frequency N from inspection immediately after the recording element is disabled, continuously disables the recording element during the determination period; and a notification unit which, in cases where the recording element is recovered from disabled to enabled, gives a notification indicating that the recording element is recovered from disabled to enabled, and in cases where the recording element is continuously disabled, gives a notification indicating that the recording element is continuously disabled, wherein the notification unit gives a notification by putting a stamp on a medium.

* * * * *